US005826451A

United States Patent [19]

Cook

[11] Patent Number: 5,826,451

[45] Date of Patent: Oct. 27, 1998

[54] KEY OPERABLE LOCKING MECHANISM

[75] Inventor: Brian Arthur Cook, South Melbourne, Australia

[73] Assignee: Bacoz Developments Pty Ltd., Victoria, Australia

[21] Appl. No.: 765,645

[22] PCT Filed: Jun. 30, 1995

[86] PCT No.: PCT/AU95/00394

§ 371 Date: Dec. 31, 1996

§ 102(e) Date: Dec. 31, 1996

[87] PCT Pub. No.: WO96/01354

PCT Pub. Date: Jan. 18, 1996

[30] Foreign Application Priority Data

Jul. 1, 1994 [AU] Australia ..... 66135/94

[51] Int. Cl.[6] ..... E05B 27/00

[52] U.S. Cl. ..... 70/495; 70/358; 70/419

[58] Field of Search ..... 70/495, 496, 356, 70/358, 377, 419–421

[56] References Cited

U.S. PATENT DOCUMENTS

| | | | |
|---|---|---|---|
| 1,969,012 | 8/1934 | Jacobi | 70/421 X |
| 2,003,086 | 5/1935 | Liss | 70/421 X |
| 2,375,682 | 5/1945 | Olson | 70/419 X |
| 3,035,433 | 5/1962 | Testa | 70/495 |
| 3,967,481 | 7/1976 | Schlage | 70/419 X |
| 4,404,824 | 9/1983 | Hennessy | 70/358 X |
| 4,478,061 | 10/1984 | Preddey | 70/358 |
| 4,524,593 | 6/1985 | Hennessy | 70/358 |
| 4,750,342 | 6/1988 | Nakai | 70/496 |
| 4,771,620 | 9/1988 | Kleinhany | 70/358 X |
| 4,966,021 | 10/1990 | Boag | 70/383 |
| 5,067,335 | 11/1991 | Widen | 70/419 X |
| 5,540,071 | 7/1996 | Reikher | 70/495 |

FOREIGN PATENT DOCUMENTS

| | | | |
|---|---|---|---|
| 103532 | 3/1984 | European Pat. Off. | 70/495 |
| 2410718 | 8/1979 | France | 70/495 |
| 403028474 | 2/1991 | Japan | 70/356 |
| 403290574 | 12/1991 | Japan | 70/356 |
| 864968 | 4/1961 | United Kingdom | 70/495 |
| 8800636 | 1/1988 | WIPO | 70/402 |
| 93012313 | 6/1993 | WIPO | 70/358 |

*Primary Examiner*—Suzanne Dino Barrett
*Attorney, Agent, or Firm*—Merchant, Gould, Smith, Edell, Welter & Schmidt, P.A.

[57] ABSTRACT

A tumbler assembly for a key operable locking mechanism (hereinafter referred to as a "key mechanism"), includes support means (12) and a plurality of tumblers (14) mounted in the support means. The assembly, suitably orientated relative to a three-axis co-ordinate system for which it is appropriate to designate the axes as being vertical, lateral and horizontal, has tumblers (14) mounted in the support means (12) in a random or sequential series which extends longitudinally in the support means. The tumblers (14) are mounted for movement to and away from a respective active position by substantially linear movement. The support means has first **(14*a*) and second (14*b*) laterally opposite sides, with each tumbler accessible at each of those sides. Each of the tumblers (14) is configured at the first side (14*a*) for effecting its movement by engagement with a configured key blade of a suitable key presented longitudinally (20) along the first side (14*a*). At least one of said tumblers (14) is reversibly movable in the vertical direction to and away from its active position, by at least substantially linear movement upon engagement with the key blade, and is accessible at the second side (14*b*)** over or during the course of its movement in the vertical direction over at least a major part of its full extent at the second side.

42 Claims, 7 Drawing Sheets

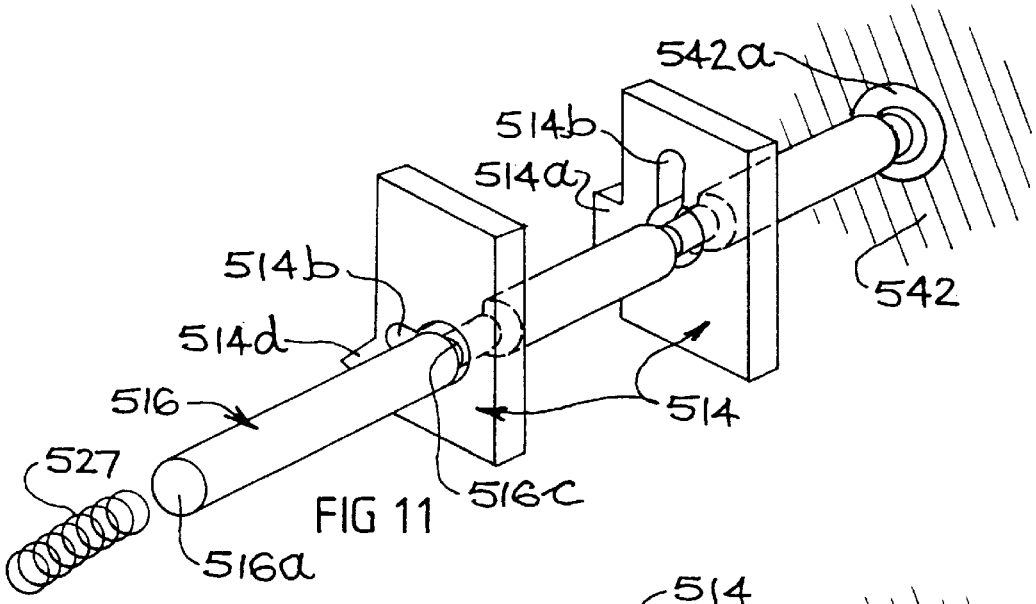
FIG 11
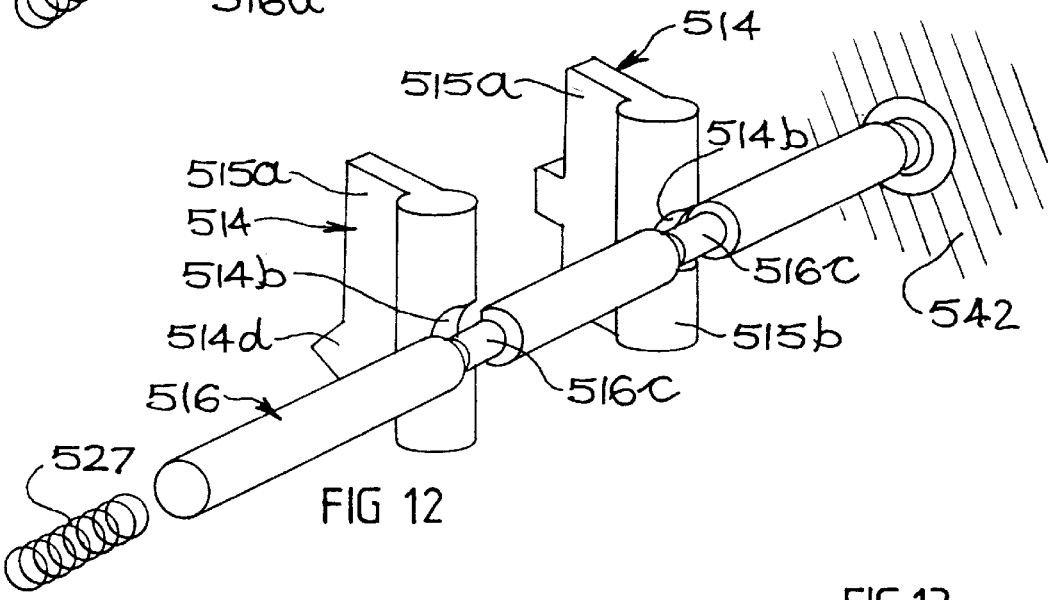
FIG 12
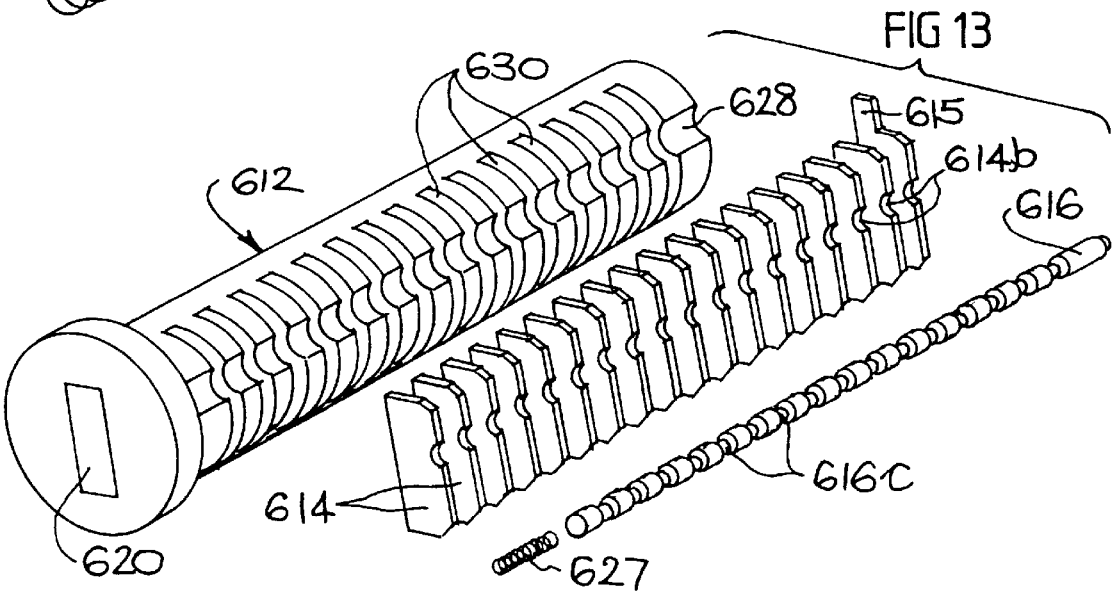

KEY OPERABLE LOCKING MECHANISM

This invention relates to a key operable tumbler assembly, and to a key operable locking mechanism (hereinafter referred to as a "key mechanism) having the tumbler assembly.

One application for the tumbler assembly is in a mechanical locking/unlocking key mechanism for a lock, such as a cylinder lock. However, in another application, the tumbler assembly may be used in a mechanical/electrical key mechanism operable to monitor and/or enable/disenable and electrically operable system, such as a microprocessor, a security access device or the like in which the assembly is able to connect/disconnect enabling electrical circuitry for the system.

The tumbler assembly of the invention functions relative to a three-axis co-ordinate system. For ease of description, it will be assumed throughout that the assembly is oriented relative to such co-ordinate system in which it is appropriate to designate the axes as being vertical, lateral and longitudinal.

In its broadest form, the invention provides a tumbler assembly for a key operable locking mechanism (hereinafter referred to as a "key mechanism"), including support means and a plurality of tumblers mounted in the support means; wherein, with the assembly suitably orientated relative to a three-axis co-ordinate system for which it is appropriate to designate the axes as being vertical, lateral and horizontal, the tumblers are mounted in the support means in a random or sequential series which extends longitudinally in the support means; wherein the tumblers are mounted such that each tumbler is able to move to and away from a respective active position by substantially linear movement, wherein the support means has first and second laterally opposite sides, each tumbler is accessible at both the first and second of said sides, each of the tumblers is configured at said first side for effecting its movement by engagement with a configured key blade of a suitable key presented longitudinally along said first side; and wherein at least one of said tumblers is reversibly movable in the vertical direction to and away from its active position by at least substantially linear movement upon engagement with said key blade, and is accessible at said second side over or during the course of its movement in the vertical direction over at least a major part of its full extent at said second side.

The support means may form part of a housing which defines a longitudinal keyway which extends along said first side and in which a suitable key is insertable for engaging the first side configuration of at least each vertically movable tumbler. Alternatively, the support means may comprise a sub-housing, frame or cage which is mountable in relation to another component, of a key mechanism in which its assembly is to be used, to define such keyway along said first side.

A key mechanism according to the invention may include a housing in which the support means is received, with the housing or the housing and the support means defining a longitudinal keyway. Alternative, the support means may comprise part of a housing which defines such keyway. In each case, the keyway extends longitudinally across the first lateral side of each tumbler, while the support means may be movable, such as rotatably, or fixed.

All tumblers may be mounted in the support means so as to be capable of vertical movement. However, it is preferred that some tumblers are able to move laterally and/or longitudinally, whether or not they also are movable vertically. Some tumblers, in different stages of their movement, may be able to move vertically then laterally or vice versa, vertically then longitudinally or vice versa, or laterally then longitudinally or vice versa, with overall movement to respective active positions being the reverse of movement from those positions.

In one arrangement, at least one of the tumblers is mounted so as to have freedom of movement in two or three directions. Thus, it may be free to move vertically and laterally, vertically and longitudinally, laterally and longitudinally, or vertically, laterally and longitudinally. However, while having freedom for such movement, the at least one tumbler need not actually exercise that freedom in the moving to and from its active position by engagement with a suitable key, or in response to movement of a locking bar. The nature of the freedom is illustrated in the following, by way of example only.

In one form of the invention, the tumblers are in the form of a wafer defining major surfaces disposed vertically and laterally. Each tumbler may be located in a respective laterally extending slot which is defined by the support means, or successive tumblers may be in face-to-face sliding contact. This form of confinement can enable the tumblers to move laterally and/or vertically. However, their intended movement may, for example, by simply lateral or vertical, or a combination of lateral and vertical movement, with a departure from intended movement occurring only if an inappropriate key is used. Similarly, the tumblers can interact with a locking bar which is of a type referred to later herein as and "end bar". The tumblers may be mounted in relation to such end bar so as to be movable longitudinally, such as within the constraints of a longitudinal spacing of a lateral groove of the support means. The mounting in relation to the end bar can be such as to accord a tumbler freedom of movement vertically, laterally and/or longitudinally, even through intended movement is more limited.

In a first arrangement in which the tumbler assembly forms part of a mechanical key mechanism, the arrangement is appropriate for a cylinder lock. In this the support means comprises a cylindrical barrel which defines a longitudinal keyway along the first side of the tumblers and which is intended to be received in a housing so as to be rotatable therein. The mechanism may include a locking bar which is movable between a locking position to which it is able to be resiliently biased and in which it projects from the barrel and an unlocking position, such as for respectively preventing and enabling rotation of the barrel in the housing. In the locking position, the locking bar projects laterally or longitudinally from the barrel, for engaging in a recess defined by the housing, and is prevented from moving to its unlocking position by at least some tumblers being other than in their active positions and/or by a keyway camming means requiring the key to be appropriately inserted (and partially rotated). The arrangement is such that, with insertion of a suitable key in the keyway, the tumblers are moved to or freed to move to their active positions, enabling the locking bar to move to its unlocking position.

In a second arrangement in which the tumbler assembly forms part of a mechanical key mechanism, the arrangement is suitable for a tee handle lock. In this, the support means comprises a non-rotatable body which defines at least part of a longitudinal keyway along the first side of the tumblers. The mechanism again includes a locking bar, as in the first arrangement, except that in its locking position, the locking bar projects through a wall of the body for precluding unlocking movement of an external member.

In a third arrangement, the locking bar is in the form of a stump operatively attached to a locking bolt (such as in a lever mortise lock), and the tumblers in their active positions permit passage of the stump to its unlocking position.

In each of the first and second arrangements, the locking bar may be a side bar, in that it is able to be laterally biased to its locking position and movable laterally between its locking and unlocking positions. However, in those arrangements the locking bar alternatively may be what can be designated as an "end bar" in that it is able to be longitudinally biased to its locking position and longitudinally movable between its locking and unlocking position. In each case, the locking bar typically is of elongate form, with both "lateral" and "longitudinal" being in relation to the above-indicated context of a three-axis co-ordinate system and the longitudinal extent of the locking bar. However, in the case of the second and third arrangement in which the action of the locking bar is a side bar, it preferably will be laterally elongate, and movable laterally, with respect to the co-ordinate system.

In a tumbler assembly for a key mechanism of the first or second arrangement in which the locking bar is a side bar, the side bar extends longitudinally across the side of each tumbler at the second later side of the support means. Also, each at least those tumblers which are vertically movable to their active positions is configured at its second lateral side for engagement with the side bar when the tumbler is in its active position and the side bar is in its unlocking position. The configuration may include false indicates of the proper engagement means such that an attempt to pick the mechanism is further complicated. Any tumbler which is movable laterally or longitudinally to its active position also can be so configured at its second lateral side for such engagement with the side bar. With such laterally or longitudinally movable tumbler, the configuring may be such that the movement is as a consequence of the side bar moving to its unlocking position. However, at least in the case of a laterally movable tumbler, it may be movable by being connected to, and movable with, the side bar, rather than due to configuring.

In a tumbler assembly for a key mechanism of the first or second arrangement which has a locking bar comprising an end bar, there are two distinct forms. In the first of these the situation is similar to the situation obtained for a locking bar comprising a side bar in that, in each case, the bar extends longitudinally across the side of each tumbler at the second lateral side of the support means. However, in the second form, the end bar is intermediate the respective lateral sides of the tumblers, and it extends through a respective opening defined by each tumbler.

In each of the first and second forms, at least those tumblers which are vertically movable to their active positions are configured for engagement with the end bar; the configuring being at the second lateral side in the first form and at the openings in the second form. Any tumbler which is laterally or longitudinally movable to its active position can also be so configured at its second side or opening, for the first and second forms, respectively, for engagement with the end bar. The configuring for a laterally or longitudinally movable tumbler, it may be movable by being connected to, and movable with, the end bar rather than as a consequence of configuring.

In a fourth arrangement, the tumbler assembly forms part of a key mechanism which is able to be electronically monitored in respect of the positions of the tumblers. In this fourth arrangement, there is added, to the first or the second arrangement, a monitoring device. The monitoring device may be laterally biased towards the tumblers for engaging the tumblers at that second side, or it may be mounted at a fixed location in which it is able to engage at least one tumbler at its second side. The or each vertically movable tumbler may be configured at its second side so as to enable its position to be monitored by the monitoring device, such as relative to other tumblers or to the monitoring device. In a still further alternative, some vertically movable tumblers may have second sides which are configured, while others are unconfigured.

The monitoring device, in an electrically operable system according to the fourth arrangement may be adapted to form part of electrical circuitry in several general ways. One way can be normally on or conducting when the tumblers are in their active positions and normally off or non-conducting when at least one tumbler is not in that position. Another way can be normally off when the tumblers are in their active positions, and on when at least one tumbler is not in that position. A further way, either normally on or normally off, can have selected tumblers in their active positions and others not in such positions. A choice between these alternatives usually depends on whether or not all tumblers are configured at their second lateral sides.

In the first way in which the monitoring device can be adapted, it has a discontinuous longitudinal series of electrically conductive elements which are mounted on an electrical insulating backing and which form or are adapted to form, part of an electrically operable system such as of an electric power supply line or other electrical or electronic circuit or component of an electrically operable system. The series of elements are such that they are able to be electrically bridged by respective tumblers when the latter are in their active positions or other than those positions, depending on whether the electrically operable system is to be normally on or normally off. By way of example, the system may be a computer or a photocopier for which power supply or access control circuitry normally is off unless the system is required for use, with use necessitating insertion of a suitable key in the keyway of the key mechanism to position the tumblers in their active positions and supply of power to the system. That is, the suitable key provides unlocking of the key mechanism for use of either system. In a further example, the system may be a security alarm system for which use of a suitable key to move the tumblers to their active positions switches off power supply or other current or component to disarm the previously armed alarm system, and use of an inappropriate key activates the system due to at least one tumbler not being moved to its active position.

In the second way in which the monitoring device can be so adapted in the fourth arrangement, it has a longitudinal series of terminals for respective electrical conductors of or for control circuitry for an electrically operable system, such as a computer or a security system enabling selective access to different areas of a building. The terminals are mounted in an electrically insulating support and are spaced from each other therein. The terminals are such that selected sub-groups of them are able to be electrically bridged by sub-groups of the tumblers when the tumblers are either in the active positions or other than in those positions, such that each of a number of sub-groups of the terminals can be bridged on insertion of a suitable key to enable activation of parts of the circuitry for the system consistent with a level of security intended for that key. More than one suitable key may be able to be used, with each enabling access to the system at a respective level of security.

In a third way the monitoring device can be so adapted in the fourth arrangement, the monitoring device for the second way contains segments of a suitable circuit, which segments are required to be appropriately bridged to complete a continuity of the circuit within the monitoring device, which may be the whole part of the electrical path required to complete the overall power supply, access or activating circuitry.

In a fourth way, the monitoring function or electrically conductive function may be achieved by a mechanical switching array arranged as for a monitoring device, but being part of a self-contained component externally operated by the tumblers.

In a fifth arrangement, the assembly further includes a monitoring device having sensor means located laterally adjacent to the support means. The tumblers are adapted to influence the output of electrical or electronic components of the monitoring device. The sensor means is adapted to provide an output signal indicative of the relative positions of at least the vertically movable tumblers, when a key has been inserted in or removed from the assembly, to thereby influence the output.

Of particular relevance to the fourth and fifth arrangements, but also applicable to all arrangements, is the ability of a tumbler assembly according to the invention, and a key mechanism having that assembly, to utilise a series of tumblers of which a plurality of active position. This enables the assembly/mechanism to provide a binary or higher order output. That is, for each such tumbler, one of two active positions be an "on" and the other as "off", or to designate "zero" and "unity". This is apparent from the illustrated embodiments detailed later herein and, as will be appreciated, this facility is of particular importance in abling electronic monitoring of tumbler positions with use of a given key or two or more appropriate keys able to be used, or in controlling part-circuitry of a system able to be operated with use of a given key.

It is to be appreciated that, if required, all tumblers can be identical. Also, they all may be oriented in the same way, but have different active positions due to the configuration of an appropriate key and/or the configuration of a locking bar. However, it also is possible for some of identical tumblers to be present in a series in which they are inverted relative to other tumblers of the series.

Where tumblers are laterally and/or longitudinally movable, this may be achieved by a camming action provided by a co-operating surface of the key blade configuration and/or of a locking bar configuration. Also, longitudinal movement can be achieved by a push-pull action of an end bar or connection of a tumbler to an end bar. Similarly, lateral movement of a tumbler can be by lateral movement of a side bar, or connection of the tumbler to the side bar.

In the various arrangements for the tumblers of the tumbler assembly of the invention, and of a key mechanism having such assembly, the tumblers can be formed of metal and produced, for example, by a stamping operation from sheet metal. Thus, the tumblers in that case will be electrically conductive. However, it is also possible for the tumblers to be made of electrically non-conductive materials, such as a suitable plastics material, at least for the first, second and third arrangements. In the fourth and fifth arrangements, it is required that the tumblers be electrically conductive and, for this, the tumblers can be partly of non-conductive and partly of conductive materials, to enable electrical bridging only when required. Thus, they can be principally of conductive material and have a non-conductive insert or coating at one or more locations along the second lateral edge. Alternative, they can be principally of non-conductive material and, at one or more such location along the second edge, have a conductive insert or coating. However, at least in the case of vertically movable tumblers for the third arrangement, electrical bridging can be achieved by these tumblers being of metal and configured at the second lateral side such that each electrically contacts elements or terminals of the monitoring device, or does not provide such electrical contact, depending on whether they are at or away from the their active positions.

In any of the above arrangements, and in particular those having a monitoring device, a suitable key may contain electrical contacts and in addition may contain an electrical circuit or segments thereof in similar fashion to the monitoring device so as to compliment or supplement the combination of electrical circuitry within and formed by the tumblers, the support means and the monitoring device.

As described, the tumblers, the key, the support means and the housing, or any parts or segments of these may be manufactured so as to be non-conductive either as a whole or in part. So that either during manufacture or by partial re-manufacture or alteration the removal or addition of components, the configuration and arrangement of an electrically conductive circuit may be suitably varied and altered. So that no any or all of the tumblers, keys, support means or housing need necessarily be electrically conductive or non-conductive, or contain electrically conductive components, as these configurations and arrangements may be varied and altered according to the particular usage and facility required, such as, for example, to enable optical monitoring of the relative positions of the tumblers.

In one embodiment of the invention, there is provided a key operable locking mechanism adapted to be received in a housing to provide a locking/unlocking action, the mechanism comprising:

(a) support means comprising an elongate barrel having first and second longitudinally spaced, oppositely facing ends;

(b) a longitudinal keyway defined by and within the barrel and opening at least at said first end;

(c) a locking bar which extends at least partway along the barrel, and which is laterally spaced to one side of the keyway; and (d) a series of tumblers which extends longitudinally within the barrel with at least part of each tumbler of the series located between the keyway and the locking bar, each of a plurality of tumblers of the series being adapted to be moved to a respective active position when a suitable key is fully inserted into the keyway to enable the locking bar to retract at least partially into the barrel from an extended, locking position to an unlocking position;

wherein each tumbler of the series includes at least one tumbler which extends laterally such that a part thereof between the keyway and the locking bar has first lateral side which is adjacent and extends vertically with respect to the keyway and a second side which is adjacent and extends vertically with respect to the locking bar;

the first side of at least some of the tumblers of the series defines a key engagement configuration (hereinafter referred to as an "actuating configuration") with which a blade configuration of a suitable key is sliceable engageable, during insertion of the key into the keyway, such that the tumblers are adjustable, to achieve their active positions when the key is fully inserted, by vertical movement; and the vertically movable tumblers, at or adjacent to the second side of each, defines a locking bar engagement configuration (hereinafter referred to as an "enabling configuration") with which the locking bar is engageable or disengageable, when the active tumblers in its active position, to enable the locking bar to move to its unlocking position.

The key mechanism of that embodiment has at least two distinct forms distinguished principally by the movement of the locking bar between its locking and unlocking positions. In the first of those two forms, the locking bar moves laterally, and comprises a side bar. In the second of the two forms, the locking bar moves longitudinally and comprises an end bar. However, in a third form, it is possible in one arrangement for the locking bar to be movable simultaneously both laterally and longitudinally such as to be able to be designated appropriately as both a side and end bar.

In the first form, the second side of the vertically movable tumblers, and preferably of each tumbler of the series, is a laterally outer side across which the locking bar extends. The outer, second side defines the enabling configuration, with this comprising and hereinafter referred to as an enabling, external configuration. The second form has two variants. In the first variant, the second side of each vertically moveable tumbler, and preferably of each tumbler of the series, also is a laterally outside across which the locking bar extends, with the outer, second side defining an enabling external configuration. This first variant also is applicable to the one arrangement of the third form. In the second variant of the second form, the second side of the or each active tumbler, and preferably of each tumbler of the series, is one which is at a location intermediate the first side and a laterally outer side of the tumbler and is defined by an elongate aperture or slot in the tumbler through which the locking bar extends. The or each aperture or slot defines the enabling configuration and, to distinguish this from an enabling configuration, it is referred to as an "enabling, internal configuration".

The tumbler assembly or key mechanism of the invention can have more than one series of tumblers, with a respective locking bar being provided for each series. However, for the series of tumblers where there is only one series, or for at least one series of tumblers where there is more than one series, there can if required by two or more locking bars.

At least the vertically movable tumblers of the or each series may be in the form of a plate-like wafer or leaf. Particularly where of such form, each tumbler preferably is thin, ie. its thickness in the longitudinal direction, between major surfaces of the tumbler, is small relative to the dimensions of its major surfaces. In one preferred arrangement all tumblers of the or each series are in the form of a plate-like wafer or leaf, such as with the major surfaces substantially parallel to the vertical and lateral directions.

In the tumbler assembly or key mechanism of the invention, each of a plurality of tumblers of the or each series may be located in a respective one of a series of lateral slots formed in and spaced longitudinally of, the barrel (or support means). In such case, each slot in the barrel may be laterally offset to one side of the keyway. Also each slot has oppositely facing laterally spaced inner and outer edges, with the inner edge opening to the keyway. The out edge of each slot opens to an external, peripheral surface of the barrel in the first and third forms of the invention and in at least the first variant of the second form, but this is not necessary in the second variant of the second form.

In one alternative to each tumbler being located in a respective slot, successive tumblers may be in sliding contact. Thus, where of plate-like form, there may be face-to-face sliding contact over major surfaces of successive tumblers. In a still further alternative, some may be in such contact, with others each in a respective slot.

In the tumbler assembly or key mechanism of the invention, there may be at least two forms of tumblers, herein distinguished as "active" in the case of vertically movable tumblers and "passive" in the case of laterally and longitudinally movable tumblers. At least some active tumblers are present in the or each series of tumblers, and all tumblers may be active tumblers, with each able to achieve its active position by vertical movement. It is highly desirable that there be at least one passive tumbler, with there preferably being a plurality of passive tumblers. A passive tumbler differs from an active tumbler in that, as a main characteristic, a passive tumbler is movably laterally or longitudinally in contrast to vertical movement of an active tumbler. However, while active and passive tumblers can be so distinguished, it is to be understood that at least one tumbler of the or each series can have the main characteristic of each type, as explained later herein, and thus be an active-passive or passive-active tumbler. Also, there may be at least a third type of tumbler which is a "neutral" tumbler and which performs no action on insertion of a suitable key, but which is designed to exclude operation of an inappropriate key.

In the following description, it is assumed that except where indicated otherwise there is a plurality of passive tumblers. It is also assumed that each tumbler is located in a respective slot defined by the barrel (support means) and that the mechanism is receivable. Additionally it is assumed that except where indicated otherwise, the mechanism is in accordance with the first form of the invention.

Each active tumbler is vertically movable, with respect to the axis of rotation of the barrel and lateral spacing between the inner and outer edges of its slot. At the inner edge of its slot, each active tumbler defines an edge shape or actuating configuration by which it is engageable by or co-operable with a configuration defined along the blade of a suitable key, as the key is received in the keyway, to thereby move each active tumbler to, or maintain it is in its active position. At its enabling, external configuration, each active tumbler is engageable with the locking bar, at least when the active tumbler is in its active position, to enable the locking bar to be retracted into the barrel to its unlocking position.

Each passive tumbler is laterally movable in its slot, laterally with respect to the axis of rotation of the barrel.

The passive tumblers may be laterally movable in response to insertion of a suitable key into the keyway. However, they alternatively may be movable in response to retraction of the locking bar into the barrel. In the case of a passive tumbler movable in response to retraction of the locking bar, the movement may be by the locking bar simply engaging an edge of the tumbler at the outer edge of its slot. Alternatively, at least one of the passive tumblers may be integral with or connected to, and movable with, the locking bar.

The slots of the series may be substantially at right angles to the axis of rotation of the barrel. This is highly desirable, at least for ease of manufacture. However, the slots can depart from such arrangement if required, although it is preferred that all slots of the series are substantially parallel to each other.

Given that each slot of the series has respective edges opening to the keyway and to the out surface of the barrel, it will be appreciated that the slots of the series are radially offset from the keyway in a common direction, laterally of the axis of the rotation of the barrel and its keyway. The arrangement may be such that, considered axially of the barrel, successive slots of the series substantially fully overlap. However, if required, successive slots may be angularly offset so as to only partially overlap. In the latter case, the slots of the series may, for example, be in a part-helical array.

The locking bar may be biased by resilient biasing means, such as compression springs or torsion springs, to a position in which it projects from the recess defined by the barrel, to enable it to be located within a recess of a housing in which the lock mechanism is mountable. With the key mechanism mounted within the housing and the locking bar biased to that position and located in the recess of the housing, the barrel of course may be locked against rotation relative to the housing. With each tumbler correctly positioned, ie. in its active position or in the case of a passive tumbler, movable to its active position by retraction of the locking bar, the locking bar is able to retract into the barrel. In one arrangement, the locking bar is able to be retracted, against the action of the biasing means, by a camming action imparted by a side edge of the housing recess as the barrel is rotated manually via the key.

Where the locking bar is retractable against the bias of resilient means, as described in the immediately preceding paragraph, the bar is able to be reversibly, laterally translated between projecting and retracted positions. However, alternative arrangements are possible with an important alternative being that of rotation of a locking bar of angular or serrated cross-section. In that alternative, this bar extends in a recess defined along the barrel. However, the bar is mounted in the recess so as to be rotatable about a longitudinal axis thereof which is substantially parallel to the axis of the barrel. The mounting is such that, as the bar is rotated, successive longitudinal edges or serrations thereof project beyond or are retracted within the recess. An edge or serrations of the bar then when projecting from the recess provides the means by which the barrel is able to be restrained from rotating relative to a cylinder in which the lock mechanism is mountable.

For the locking bar to be retractable, each active tumbler needs to have been moved to its required active position, thereby enabling inter-engagement between the locking bar and those tumblers. In retracting, the locking bar causes each passive tumbler to be moved to or maintained in its required active position, subject to the key configuration not only being appropriate for the active tumbler configurations, but also for each passive tumbler.

A key for use with the key mechanism has at least one blade which is suitably configured so as to be co-operable with at least the active tumblers. The key blade may have millings, such as dimples, providing the configuration. Alternatively, the configuration may be provided by bittings such as V-cuts, a sidetrack such as grooving, a waveform such as a centre fin, or a combination of two or more of such millings, bittings, sidetrack and waveform. Also, when providing the configuration, the sidetrack, millings, V-cuts or waveform can be of constant or varying depth.

The actuating configuration by which each active tumbler is engageable or co-operable with the key blade may be of a complementary form, or of a partial complementary form, to the key blade configuration of a suitable key. Thus, where the key blade configuration provides a projecting milling or waveform with which a given active tumbler is to engage, the actuating configuration of that tumbler can comprise a cut-out, groove or gate in which the key blade configuration is receivable. Depending on the required movement of the tumbler on engagement with the key blade, the shape of the cut-out, groove or gate may be of a simple symmetric form or may be of a complex form to thereby influence this movement. Similarly, where the key blade configuration provides a bitting or sidetrack with which a given active tumbler is to engage, the edge configuration of that tumbler can comprise a spigot or projection which is receivable within the key blade configuration. Again, the shape of the spigot may be of simple symmetrical form or may be of complex form, such as including notches in its base and/or on one or both sides, to influence the movement of the tumbler on engagement with the key blade. In each case, engagement between each actuating configurations and the key blade configuration moves or maintains each active tumbler such that, with the key appropriately received in the keyway, each active tumbler is positioned vertically in its respective active position. As the key blade is progressively received into the keyway, its configuration typically may cause vertical movement of each active tumbler in one or other direction (ie. up and/or down), with attainment of the required active position being achieved when the blade is appropriately received in the keyway. In that case, insertion of an inappropriate key will not achieve such movement of at least some of the active tumblers, thereby blocking the engagement of their enabling configurations with the locking bar required for retraction of the latter.

In an alternative arrangement there may be substantial vertical tolerance clearances, for at least some of the active tumblers, between the actuating configuration of each of those tumblers and the key blade configuration of a suitable key. For active tumblers for which this applied, they may simply remain in their active positions on insertion of that key, and be held by its blade configuration in those active positions. However, for an inappropriate key, there will be different tolerance clearances, such that the active tumblers will be moved away from their active positions by the blade configuration of the inappropriate key, thereby blocking engagement of their enabling configurations with the locking bar required for retraction of the latter.

The enabling, external configuration by which each active tumbler is engageable with the locking bar is one which is configured to receive at least one projection portion of the locking bar, or to project into a recessed portion of the locking bar. In each case, such engagement is to be possible only when each active tumbler is in its active position along the third line. In one arrangement, the locking bar has a locating blade formed therealong which projects from a main body portion thereof towards the keyway. In that arrangement, each active tumbler is configures to define an enabling, external configuration in the form of a gate into which the blade is receivable when the tumbler is in its active position. In an alternative, similar arrangement, the locking bar may have a parallel pair of locating blades, each receivable into a respective gate of the enabling, external configuration of each active tumbler. In a still further alternative, the locking bar may have a parallel pair of locating blades, with the enabling, external configuration of each active tumbler comprising a projecting spigot receivable into a recess defined by the locking bar, between the blades. Another alternative is that the locking bar may have more than two blades. In each case, engagement between the enabling, external configuration of the active tumblers and the locking bar is to be possible only with those tumblers all in their active positions, as established by a suitable key. That is, with positioning of the active tumblers by an inappropriate key, as may be possible, the enabling, external configuration by which some or all of the active tumblers are intended to engage the locking bar will in fact not permit this, thereby blocking retraction of the locking bar and precluding rotation of the barrel.

The passive tumblers each have respective edges engageable with the key blade configuration and the locking bar.

These respective edges of the passive tumblers need not be configured, although they can be configured, if required, to avoid misalignment. Each passive tumbler has a lateral width between those edges which substantially corresponds to the respective lateral spacing, across each of the tumblers, between the key blade configuration of a suitable key and the locking bar when the latter is in its retracted position. Thus, for an inappropriate key for which that spacing, across any passive tumbler, is less than the width of the tumbler, retraction of the locking bar will be blocked by such tumbler.

At least some passive tumblers may be secured to an movable with the locking bar. Thus, with insertion of a suitable key and, hence, required positioning of each active tumbler, the locking bar is able to retract or be retracted. With retraction of the locking bar, passive tumblers secured to the bar move laterally with it so as to abut the key blade configuration.

Alternatively, at least some passive tumblers may be movable independently of the locking bar. In such case, they can be moved laterally by either the key blade configuration or the locking bar for contact with each of the key blade configuration and the locking bar when the latter is in its retracted position.

Whether or not any passive tumbler is connected to the locking bar, it precludes retraction of the locking bar where it has a lateral width which exceeds a lateral spacing thereacross from the key blade configuration and the locking bar.

As indicated above, at least one tumbler can have the main characteristic of both active and passive tumblers. That is, such tumbler, hereinafter designated as an active-passive or passive-active tumbler, may be movable both vertically and laterally. An active-passive tumbler is one which, on insertion of a suitable key into the keyway, initially moves vertically in the manner of an active tumbler and thereafter laterally in the manner of a passive tumbler; while a passive-active tumbler is one for which initial movement is lateral and then vertical. However, it also is to be understood that movement in each manner can be at least partially concurrent, rather than sequential.

In the case of an active-passive tumbler, initial vertical movement results from engagement between its actuating configuration and the configuration defined along the blade of a suitable key. With the key appropriately inserted into the keyway and the tumbler thus moved vertically to its active position, the tumbler then is able to move laterally by retraction of the locking bar. The vertical movement is achieved in one case by a fin of the key blade configuration being received in a gate of the actuating configuration of the tumbler, or by a spigot of the actuating configuration received in a groove, milling or V-cut of the key blade configuration. In the case of the fin and gate arrangement, the height of the fin laterally relative to the depth laterally may be such that the tumbler is able to be moved laterally by retraction of the locking bar so that the fin projects further into the gate. In the case of the spigot and groove arrangement, the situation may be analogous in that the tumbler is able to be moved laterally be retraction of the locking bar, so that the spigot projects further into the groove.

With a passive-active tumbler, initial lateral movement can result from retraction of the locking bar to engage the tumbler and move the tumbler so it engages the configuration of the fully inserted key blade. Alternatively, initial movement can be by the key blade configuration engaging the tumbler and moving it so as to be engaged by the locking bar when the latter retracts. In each case, with the tumbler engaged at respective lateral sides by the locking bar and the key blade configuration, the tumbler then is able to be moved vertically. For that vertical movement, there may be a cam surface defined by the key blade configuration which engages with a complementary cam surface of its respective edge of the tumbler and/or a cam surface of the locking bar which engages with a complementary cam surface of its respective edge of the tumbler. In the or each case, the complementary cam surfaces may be included with respect to each of vertical and lateral directions. Thus, the arrangement may be such that a force applied to the tumbler, as a consequence of its being engaged by both the key blade configuration and the locking bar, is resolved so as to provide a component thereof acting, and thereby moving the tumbler vertically.

Vertical, longitudinal and/or lateral movement of the tumblers most preferably is at successive stages of overall movement to and away from their active positions. However, for at least some tumblers able to move in two or all three of those directions, the movement can at least be substantially simultaneous. However, even where simultaneous, the movement most preferably has a linear component in each direction concerned, while the movement in each stage, where it is sequential, also most preferably is substantially linear. Where movement is solely vertical, lateral or longitudinal, it again most preferably is substantially linear. Thus, at least in more preferred forms, the tumblers move in a substantially constant orientation relative to the support means or barrel. That is, the complexity of rotational movement of the tumblers can be avoided. As a consequence of these matters, all tumblers, except any capable of longitudinal movement, remain in a substantially constant longitudinal relationship to each other and are present in a constant longitudinal distribution pattern with respect to a keyway, a key blade received in the keyway and a side bar of a key mechanism in which they are provided. The pattern can be regular or irregular, as required.

There are numerous variations possible in the tumbler assembly and key mechanism of the invention. These now are briefly outlined, as they illustrate important options for the invention which increase the number of combinations possible, enable recombination of the mechanism, enhance the level of pick-resistance of a lock have the key mechanism and/or extend the range of applications for the mechanism. Except where indicated, the variations can be used in combination with each other.

The keyway may open at each of the first and second end of the barrel. With this arrangement, the tumblers are disposed in the series in a manner which enables all of them to be moved to their active positions with insertion of a suitable key from either end of the keyway. In one simple form which is not exhaustive of all possibilities, the tumblers in one half of the series can have the same variation in form, but be in a reversed order relative to those of the other half of the series.

In the preceding description, there is reference to a series of tumblers and a locking bar. With a single keyway, whether open at one or each end of the barrel, there can be two or more series of tumblers, each with an associated respective locking bar. With two or more series of tumblers, each locking bar is laterally spaced to a respective side of the keyway, with each series of tumblers between its locking bar and the keyway. In this variant, there will be a respective lateral direction along which each locking bar is spaced from the keyway, and along which any passive tumblers of a given series will be moveable. There also will be a respective longitudinal direction for each active tumbler of a given series which is mutually perpendicular to the respective lateral and longitudinal direction for that series. Thus, with a cylindrical barrel and, for example, two locking bars, the latter may be oppositely spaced so as to be diametrically opposed. With four locking bars, they may be angularly offset at about 90° intervals.

Where there are two diametrically opposed series of tumblers, the keyway may have an elongate, rectangular cross-section in which a flat key blade which is configured on each major face is receivable. Where there are four series of tumblers angularly offset at 90° intervals, the keyway can be square in cross-section and able to receive a key blade of similar section which is configured on each of its four faces. However, with two or more series of tumblers, it is not necessary that these can be angularly offset at uniform intervals. Also, whether there is only one or more than one series of tumblers, it is not necessary that the keyway and the blade of a suitable key be of polygonal cross-section.

The or each locking bar need not be continuous along its series of tumblers. Indeed, there can be benefit in increasing pick-resistance by using a locking bar comprising at least two separate shorter bars in end-to-end alignment.

The or each locking bar may be resiliently biased to its locking position by biasing means, such as by springs. In such case, the locking bar is movable to its unlocking position against the action of the biasing means. In movement between its locking and unlocking positions, the locking bar may be laterally movable in a substantially constant orientation relative to the barrel. However, in moving between those positions, the locking bar may be laterally movable and also rotated about its longitudinal extent so as to change is orientation relative to the barrel. In a first arrangement, involving such rotation, the locking bar may be in the form of a rod which rotates through a substantial angle as it moves laterally. In a second arrangement, the locking bar may simply rotate through a relative small angle, with its rotation being in the nature of pivoting or canting action, such as to present it is a required orientation for engagement with enabling configurations of the tumblers.

In general, a single keyway is used. Where this is the case, a suitable key can comprise matching longitudinal sections, whether this is on a plane which, with the key received in the keyway, is parallel to the lateral or vertical direction. This enables an increase in security, due to the need for the parts of the key to be available for use together. Alternatively, there may be two adjacent keyways in a common barrel, each having at least one associated locking bar and series of tumblers, but necessitating simultaneous use of two, preferably different, suitable keys.

Each of the tumblers of a series, or all tumblers of one of at least two sub-groups of a series, can be of a common form, such that they have essentially the same dimensions and configuration. Thus, where for example the active tumblers have an actuating configuration comprising a notch and an enabling, external configuration comprising a gate, the notch and gate will be at the same location for each tumbler. The actuating configuration of each tumbler will engage the key blade configuration in the same way. However, despite the common form of the tumblers, each will have a respective active position related to the part of the key blade configuration with which it is engaged when the key is appropriately inserted into the keyway. As a consequence, the notch and gate of each tumbler will be at respective vertical positions, necessitating that the locking bar has a configuration which enables it to be received in each gate. For this, the locking bar configuration needs to be related to that of the key, blade configuration.

The or each active tumbler can have an actuating configuration which is engageable with the key blade configuration of a suitable key in a manner such that the active tumbler is moved to its active position solely as a consequence of insertion of the key appropriately into the keyway. In such case, the active position for the or each active tumbler is achievably as a consequence of linear movement of the key along the keyway. However, in an alternative arrangement, the or each active tumbler can be moveable to its active position by partial rotation of the key, when fully received into the keyway.

A further alternative is an arrangement in which at least one vertically and/or longitudinally movable tumbler is held in an inactive position by an end bar and would usually be released by insertion of a suitable key which would allow the tumbler to then move to its active position by either biasing means, a side bar, auxiliary bar or end bar. In this further alternative, releasing of the tumblers other than by a suitable key would mean that at least some of the tumblers would move beyond their active position upon being released which would significantly improve the pick resistance of the mechanism.

While the key mechanism of the invention utilises a different form of tumbler to those conventionally used, it additionally can include a conventional series of pin tumblers. However, where such pin tumblers are included, it generally is preferred that the different tumblers required by the invention be such that each active tumbler achieves its active position as a consequence of linear movement of the key along the keyway, rather than by partial rotation of the key when fully received into the keyway.

In part of the preceding description, it is indicated that it is assumed that the mechanism is in accordance with the first form of the invention. While much of the description subject to that assumption applies to other forms, differences in the other forms now will be described. In the first form, the locking bar is moveable laterally with respect to its own extent along the barrel, i.e. laterally with respect to the longitudinal direction. In the first and second variant of the second form, the locking bar is movable in the direction of that extent, i.e. along the barrel. The locking bar of the second form may be biased by resilient means, such as a compression spring, to a locking position in which it projects beyond an end of the barrel. Thus, in moving to its unlocking position, the locking bar is moved against the action of the biasing means. However, other arrangements are possible for the locking bar of the second form of the invention, in that it need not project beyond an end of the barrel. Thus, for example, while a major part of the locking bar extends along the barrel, it may have an end portion which is bent of formed so as to project laterally from the barrel.

Where the key mechanism of the second form of the invention is receivable in a housing in which it is to be rotatable, the locking bar when in its locking position engages in a recess defined by the housing to prevent rotation of the barrel. In this case of a locking bar which projects beyond an end of the barrel, it simply locates in the recess and is retracted form the recess on moving to its unlocking position. However, where the locking bar has a laterally projecting end portion, a different arrangement is necessary in that the end portion may project laterally from the barrel at all stages of movement between its locking and unlocking positions. To accommodate this, the recess defined by the housing may include an annular groove which extends around the barrel and in which the end portion of the locking bar is located when in its unlocking position. Thus, with rotation of the barrel, the projecting portion is able to be drawn around the groove. To enable the locking bar to lock the barrel against rotation in the housing, the recess defined by the housing further includes a side gallery which extends to one side of the groove, at a location on the circumference of the groove at which the end portion is positioned when the barrel is in a position for retraction of its key. The gallery is at the side of the groove to which the locking bar is moveable under the action of the biasing means, such that the end portion is able to locate in the gallery.

In the first variant of the second form of the invention, the tumblers have an enabling, external configuration with which the locking bar is engageable, although the form of engagement differs from that of the first form. The locking bar is recessed at intervals along its length, such as by provision of annular grooves in the case of a locking bar of circular, serrated, polygonal, oval or deformed cross-section. The enabling, external configuration of each active tumbler may comprise a gate dimensioned to accommodate a full cross-section portion of the locking bar when in its active position, to enable movement of the locking bar from its locking to its unlocking position. However, the gate is dimensional such that when moved from its active position, a side of the gate locates in a recessed portion of the locking bar to preclude movement from the unlocking position. In this case, the active tumbler-engages the locking bar when in the locking position, but disengages the locking bar to enable its movement to the unlocking position. However, the converse of this arrangement is possible for at least one active tumbler. The arrangement for passive tumblers is similar, and may be such as to either disengage the locking bar for movement to is unlocking position or to engage the locking bar when in that position.

In the second variant of the second form of the invention, the tumblers have an enabling, internal configuration which may comprise an aperture in the form of a keyhole. The locking bar extends through the apertures and again is recessed along its length. With each of at least of the tumblers, when in its active position, the locking bar is able to move from its locking to its unlocking position, due to each tumbler when in its active position having the larger part of its aperture located such that the locking bar extends therethrough, the larger part enabling a full cross-section portion of the locking bar to be received therein. However, the smaller part of the keyhole apertures are dimensional so as to exclude the full section of the locking bar and to engage with a recessed portion of the bar. This applies to both active and passive tumblers but, given that these respectively move vertically and laterally, each keyhole aperture has its larger and smaller parts adjacent along the respective line.

While the second variant of the second form is illustrated with reference to apertures in the form of a keyhole, it will be evident that other arrangements are possible. Also, it is to be appreciated that the enabling, internal configurations need not comprise apertures, but can comprise slots each extending inwardly from an edge of its tumbler.

The key mechanism according to the third form of the invention will be understood from the description with reference to the first form and the first variant of the second form. The third form is, in effect, a combination of the first form and that first variant, with the locking bar being biased by respective springs for movement in each of the two directions, i.e. both laterally and longitudinally.

In preceding description, there is reference to numerous variations discussed with reference to the first form of the key mechanism. It is to be understood that these also are applicable to the first and second variant of the second form, and to the third form.

In general, it is convenient to have the keyway disposed centrally within the barrel. However, it also to be understood that the keyway can be disposed asymmetrically, such as to be adjacent or even open to the external peripheral surface of the barrel.

As a security measure, the barrel can be formed to safeguard against its forced removal from a housing in which its key mechanism is mounted. For this, the barrel can intentionally be formed with a zone of weakness at a location intermediate its ends; the zone preferably being oblique to the longitudinal axis. The zone may be such that, in the event of attempted forced extraction of the barrel from the housing, the housing will rupture or shear at that zone, to leave at least part of its length within the housing.

As indicated at the outset, the tumbler assembly of the invention has at least one tumbler which is reversibly movable in the vertical direction. Preferably there is a plurality of such tumblers. The movement in the vertical direction may be linear vertical movement substantially parallel to the vertical axis, or movement with both a component substantially parallel to that axis and a component substantially parallel to the lateral and/or longitudinal axis. However, it is highly desirable that the movement does not involve rotation on any axis, other than a permissible degree of canting or tilting relative to the longitudinal axis. Similar considerations apply to tumblers which are not movable in the vertical direction.

As also indicated at the outset, the at least one tumbler which is reversibly movable in the vertical direction is accessible at the second side of the support means, over at least a major part of its full extent at the second side, in the course of its vertical movement. The tumblers may be accessible at the second side to the extent that they are able to be inserted laterally into the support means at that side. This is particularly desirable where, for example, each tumbler is located in a lateral slot in the support means, as this can facilitate mounting of the tumblers in and their removal from the support means.

Access to the tumblers at the second side of the support means, of course, is required where the support means comprises the barrel of a cylinder lock, and is to be co-operable with a side bar for preventing and enabling rotation of the barrel in a cylinder of the lock. When the support means is mounted in the cylinder, access to the tumblers at the second side is lost in one sense, in that the cylinder encircles the support means and thus extends across an opening in the support means at the second side thereof. In some forms of the invention, such opening is required for the positioning of a side bar which is to interact with the tumblers, as well as for any guide in which the side bar is movable for interaction with the side bars. However, even where an end bar which extends through a respective aperture of tumblers, access to the tumblers at the second side of the support means still is required, such as for ease of insertion of the tumblers and the end bar and for their removal from the support means.

At one extreme, the tumblers may be accessible at the second side of the support means over their full extent at the second side such that they are insertable into and removable from the support means at the second side. That is, the support means may have an opening at the second side which accommodates the maximum dimensions of the tumblers in the vertical direction therethrough. However, to the extent that the tumblers can be inserted or removed at any angle, the opening can be less than this. Also, it is not necessary that the tumblers be insertable or removable through the opening at the second side and, in such case, the opening may be substantially less than required for such insertion and removal. However, the support means is to be open to an extent that, for each vertically movable tumbler, such tumbler is accessible, at least during the course of its vertical movement, over a major part of its extent in the vertical direction. Thus, for example, where the assembly has a side bar accessible to the tumblers, a major part of the vertical extent of the vertically movable tumblers is to be able to traverse the side bar in the course of their vertical movement, so as to be progressively accessible to and contactable with the side bar at any location along that major part. The vertically movable tumblers may be so contactable by the side bar at a common opening in the support means or at a respective opening.

In order that the invention may more readily be understood, the description now is directed to the accompanying drawings, in which.

Figure 1:
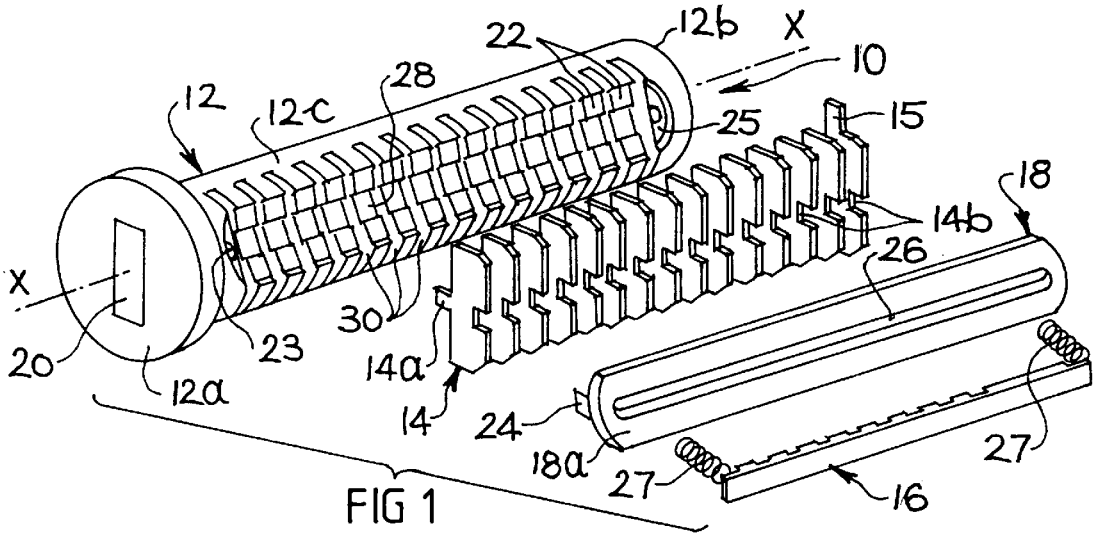
FIG. 1 is an exploded, perspective view of a tumbler assembly according to the invention as embodied in a key mechanism.
Figure 2:
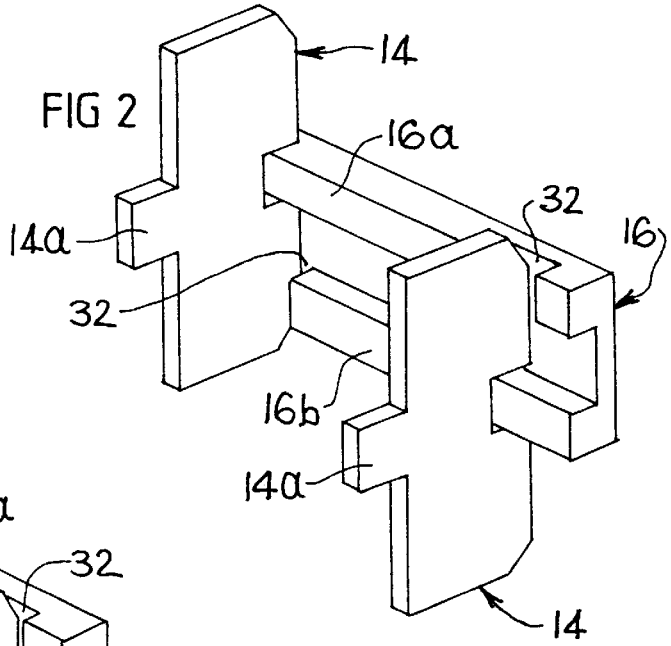
FIG. 2 is a partial perspective view showing inter-engagement of components of the assembly/mechanism of FIG. 1.
Figure 3:
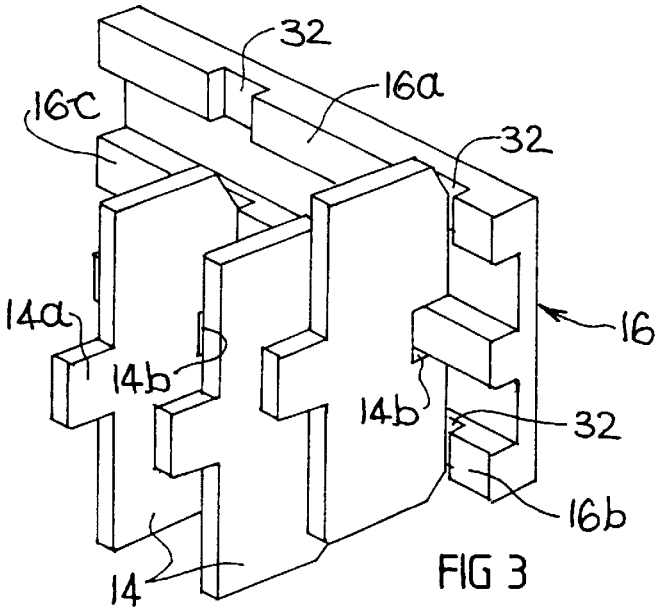
Figure 4:
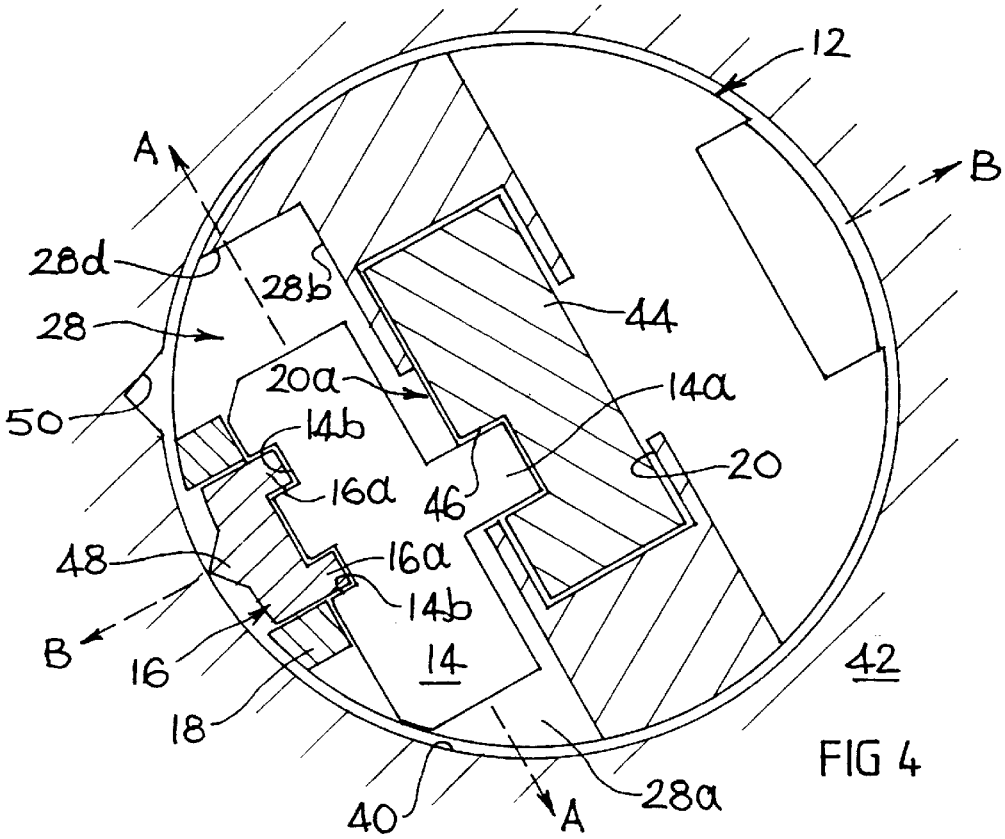
Figure 5:
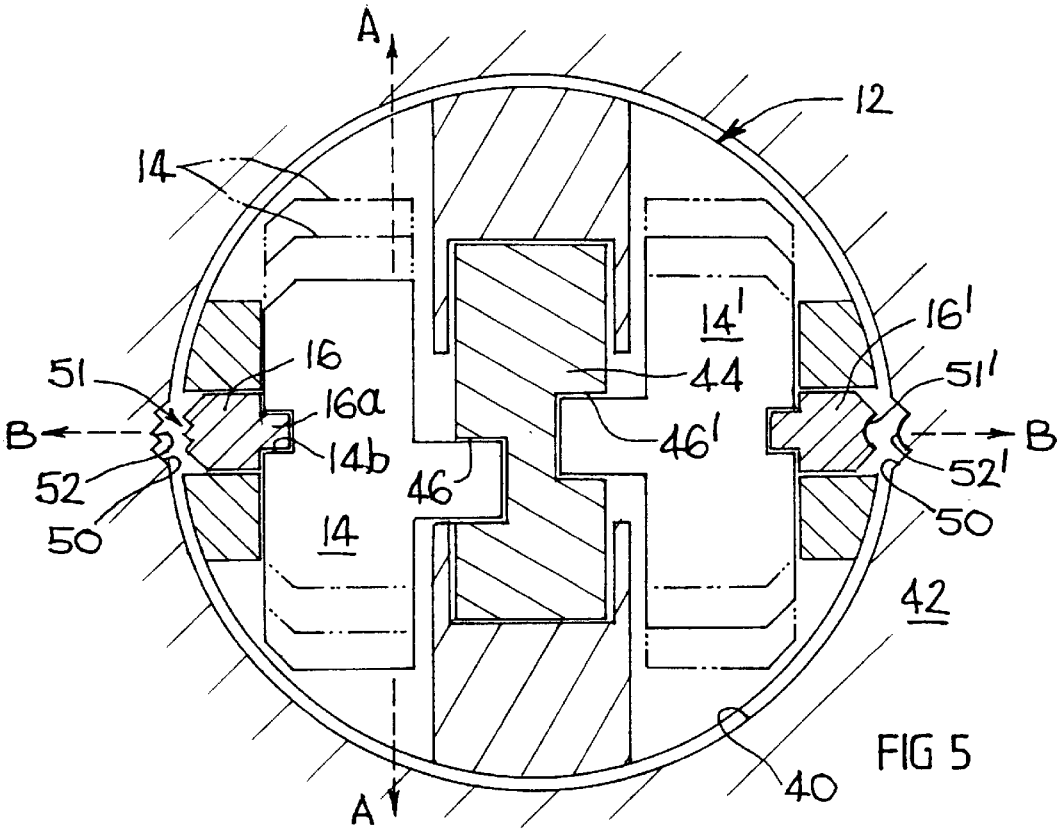
Figure 6:
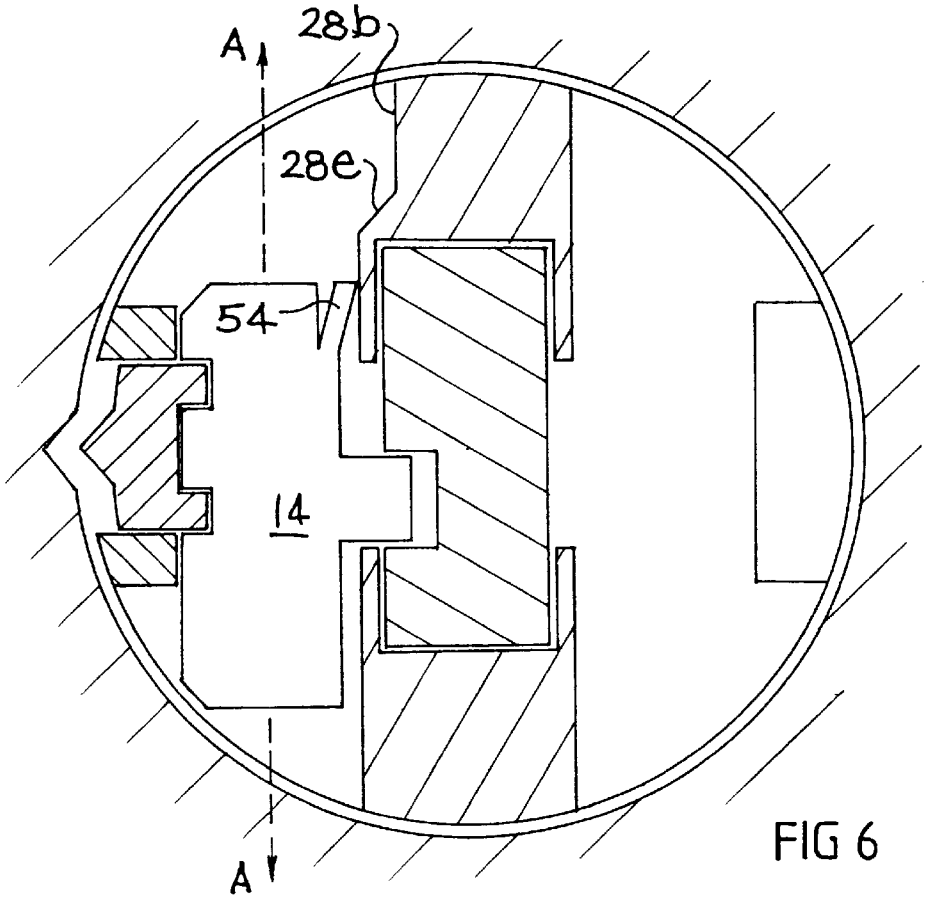
Figure 7:
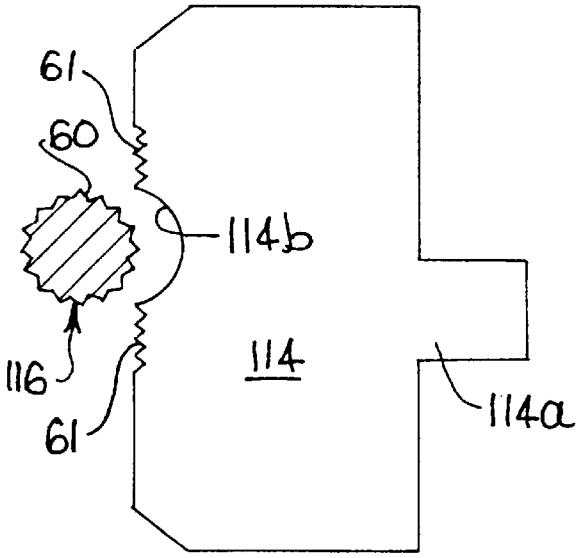
Figure 8:
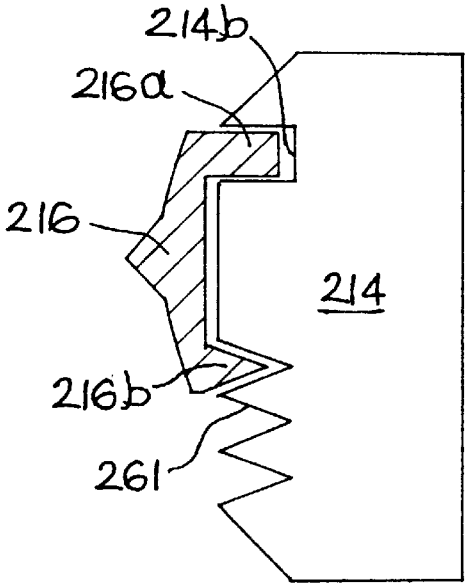
Figure 9:
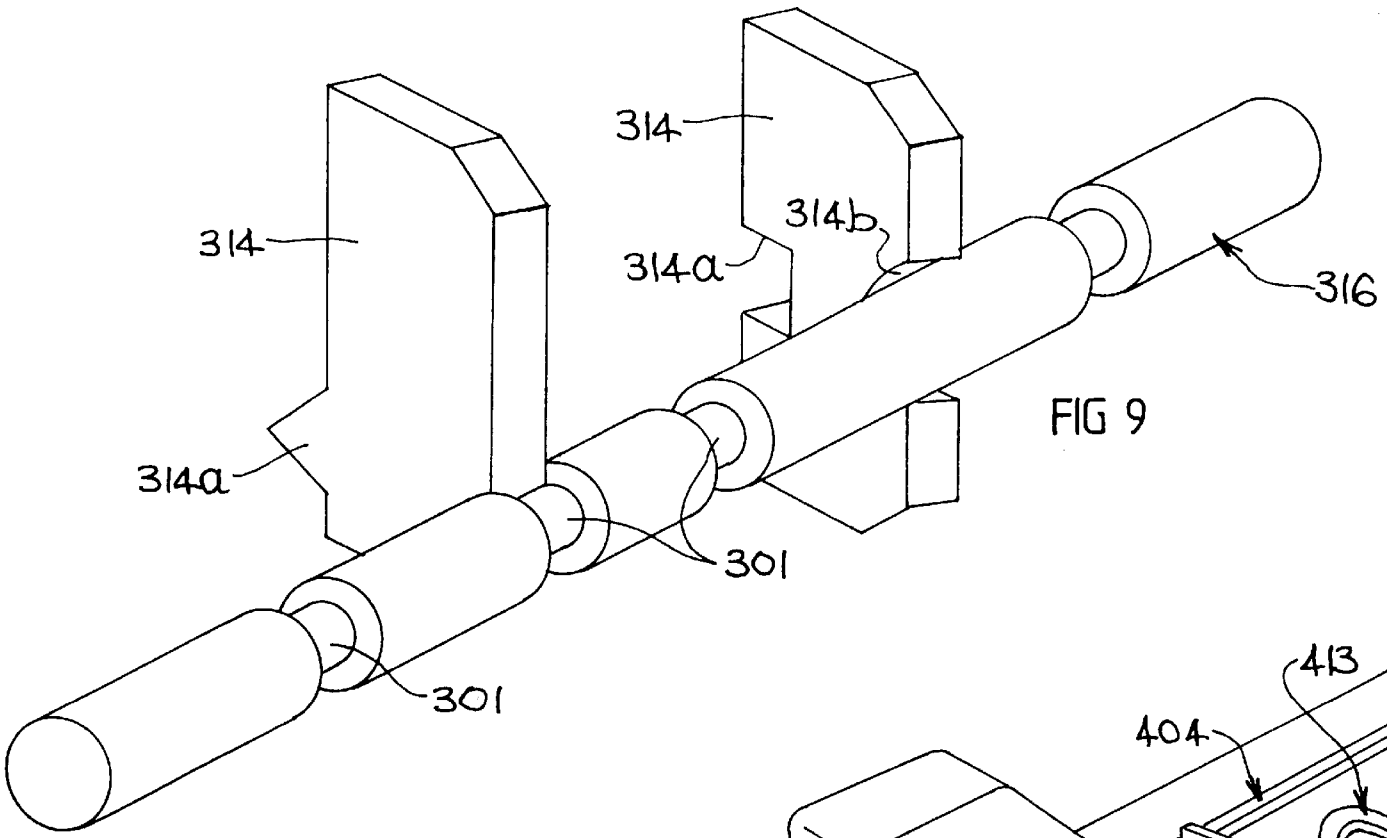
Figure 10:
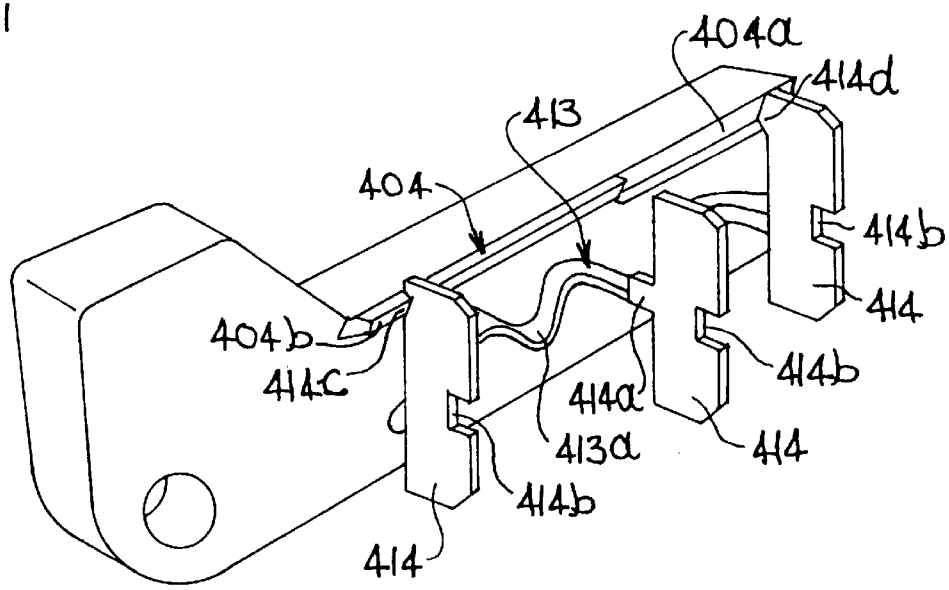

FIG. 3 provides a perspective view of an alternative form of a component shown in FIG. 2;

FIG. 4 is a transverse sectional view through another form of tumbler assembly/key mechanism;

FIG. 5 corresponds to FIG. 4, but shows a still further form of tumbler assembly/key mechanism;

FIG. 6 corresponds to FIG. 4, but shows a modified arrangement enhancing pick-resistance;

FIG. 7 is a transverse sectional view of components of a further embodiment;

FIG. 8 is a transverse sectional view of components of another embodiment;

FIG. 9 is a perspective view of components of a still further embodiment;

FIG. 10 illustrates a key in relation to components of another embodiment; and FIG. 11 is a perspective view of an alternative embodiment of the invention;

With reference to FIGS. 1 and 2, the key mechanism 10 shown therein includes a tumbler assembly having support means comprising a barrel 12 and tumblers 14. Mechanism 10 includes a locking bar 16, and a guide 18 in which bar 16 is laterally moveable.

Barrel 12 is of generally cylindrical form, and is cast or machined from suitable metal stock to define outer peripheral surface 12*c*. Barrel 12 has a longitudinal axis X—X of rotation. Centrally, within barrel 12, there is defined an elongate longitudinal keyway 20 extending inwardly, from the front end 12*a*, over a significant part of the full length to rear end 12*b*. Along one side, outer surface 12*c* of barrel 12 is cut away to define an elongate flat face 22 against which guide 18 is able to be secured; with the outer surface 18*a* of guide 18 providing a continuation of surface 12*c*. Adjacent end 12*a*, a locating depression 23 is formed inwardly of face 22, to accommodate laterally projecting tang 24 of guide 18 when the latter is received against face 22. At end 12*b* of barrel 12, a bore 25 is formed to receive a longitudinally projecting tang (not shown) at the rear end of guide 18, to secure the latter in position against face 22.

Guide 18 defines an elongate longitudinal slot 26 in which bar 16 is laterally offset from keyway 20, along a line extending radially of barrel 12, and is guided for lateral movement towards and away from barrel 12. At each end, bar 16 is provided with resilient biasing means comprising springs 27 which biases bar 16 outwardly to a position in which it projects from slot 26, beyond the radially outer extent surface 12*c* of barrel 12.

Barrel 12 has formed therein, along face 22, an elongate longitudinal recess 28 which is in line with slot 26 of guide 18. The arrangement is such that bar 16 is able to move laterally inwardly, from its outwardly projecting position, against the bias of springs 27, to a retracted position in which it is seated in recess 28. When bar 16 is in its retracted position, it is within or at least does not project beyond the radial extent of surface 12*c* of barrel 12.

Barrel 12 has formed therein a series of longitudinally spaced, laterally extending slots 30. Each slot 30 opens at its laterally inner edge to keyway 20. At its laterally outer edge, each slot 30 opens to recess 28 and face 22. Prior to positioning and securing guide 18 and bar 16 in relation to face 22, a respective tumbler 14 is located in each slot 30.

Each tumbler 14 is in the form of a flat, plate-like wafer or leaf of generally rectangular shape. At its laterally inner edge, each tumbler 14 is configured for engagement with a configuration formed on the blade of a suitable key received in keyway 20. Also, the outer edge of each tumbler 14, is configured for engagement with a configuration formed along the inner face of bar 16. However, for ease of description, the inner and outer edges of tumblers are shown as having relatively simple configured forms.

The arrangement of FIGS. 1 and 2 is such that tumblers 14 are insertable laterally into slots 30 of barrel 12 and, hence, removable therefrom. That is, slots 30 are open at face 22 to an extent accommodating this. When positioned in slots 30, tumblers 14 have freedom to move both vertically and laterally but, as evident from further description of FIGS. 1 and 2, this freedom need not be fully exercised in use of mechanism 10 with a suitable key.

At its inner edge, each tumbler 14 has a configuration comprising an inwardly projecting spigot 14*a*. Each spigot 14*a* projects into keyway 20, and is engageable in a longitudinal groove of complementary cross-section defining at least part of a configuration of the blade of a suitable key. The key blade groove may be of undulating form such that, as the key is inserted in keyway 20, spigots 14*a* are captured therein, and each tumbler 14 moves vertically due to the undulations. With the key fully inserted in keyway 20, each tumbler 14 then will be in a respective active position along a vertical line, as dictated by the undulations of the key blade configuration.

At its outer edge, each tumbler 14 has an enabling configuration comprising an inwardly extending gate 14*b*. For each tumbler 14, its gate 14*b* is positioned relative to the location of its spigot 14*a* such that, with each of tumblers 14 in its active position, its gate 14*b* is positioned so as to receive and be engageable with bar 16.

As shown most clearly in FIG. 2, bar 16 is somewhat C-shaped in cross-section, such that its innermost face configured to define a top blade 16*a* and a lower blade 16*b*. When each tumbler 14 when in its active position, one or other of blades 16*a*, 16*b* is received in its gate 14*b* when bar 16 is retracted. However, to enable this, the other one of blades 16*a*, 16*b* is cut-away to define a recess 32, as shown for blade 16*a* in the case of the nearer tumbler 14, and blade 16*b* for the other tumbler 14. Thus, for each tumbler 14, one of other of blades 16*a*, 16*b* functions as a form of spigot.

As is evidence from FIGS. 1 and 2, tumblers 14 are accessible at the face 22 of barrel 12 over their full vertical extent. However, as also evidence from those Figures and subsequent description herein, vertical movement of tumblers 14 can be such that they are at least progressively accessible to side bar 16 over a major part of that extent over or during the course of vertical movement.

FIG. 3 shows another form for bar 16. In this case, bar 16 has an E-shaped cross-section, with its inner face configured to define top, lower and intermediate blades 16*a*, 16*b* and 16*c*. Again, at least one of the blades provides a form of spigot for the tumbler 14 when in its active position, with at least one of the other blades having a recess 32 to accommodate each tumbler 14. Thus, as shown for the nearest tumbler 14, each of blades 16*a*, 16*b* defines a recess 32 which enables blade 16*c* to be received in its gate 14*b* as bar 16 is retracted. In the case of each of the next two tumblers 14, it is blade 16*b* which is received in the gate 14*b* of each, necessitating that blade 16*c* has a respective recess 32 allowing for this. The dimension of each tumbler 14 across blades 16*a*, 16*b* is such that blade 16*a* does not need to have a recess 32 for accommodating those next two tumblers 14, although blade 16*a* does in fact have an unutilised recess 32 in line with the third tumbler 14. Such unutilised recess 32 can facilitate the key mechanism being operable with two or more different keys, of which one may be a master key in relation to the others.

The location of the spigot 14*a* of each tumbler 14 may be related to and varies, from tumbler to tumbler, with the form of the undulations of the configuration of a suitable key blade. The arrangement is such that, on insertion of such key, each tumbler 14 moves vertically and, on full insertion of the key each tumbler 14, is in its required active position. Then the gate 14*b* of each tumbler 14 is in line with its respective blade of bar 16, such that the latter is able to retract in guide 18 and recess 28 of barrel 12. Hence, with key mechanism 10 mounted in a cavity of a housing (not shown), to provide a lock, bar 16 is able to move between a locking position and an unlocking position. Bar 16 is biased to its locking position by springs 27 and, in that position, it projects outwardly from guide 18 to locate in a recess defined by the housing longitudinally of its cavity to prevent relative rotation between key mechanism 10 and the housing. With each gate 14*b* positioned for engagement with a respective blade of bar 16, due to movement of each tumbler to its required active position by insertion of a suitable key, and bar 16 is retracted, mechanism 10 is able to rotate relative to the housing. This rotation is enabled by a cam action imparted by a side surface or edge of the recess defined by the housing forcing bat 16 into its unlocking position, against the action of springs 27. In the unlocking position, bar 216 is retracted into guide 18 and recess 28, so as to clear the recess of the housing, as permitted by engagement between each gate 14*b* and its respective blade of bar 16.

As will be appreciated from FIGS. 1 and 2 and the variant thereof shown by FIG. 3, insertion of an inappropriate key is likely to be able to move tumblers 14 vertically. This may result in some tumblers 14 achieving their required active position on that line. However it will not result in all tumblers 14 achieving such position, with the consequence that retraction of bar 16 will be blocked by the inability of the respective blades of bar 16 to engage with its gate 14*b* for each tumbler which is not in its required active position. One incorrectly positioned tumbler 14 is sufficient to prevent bar 16 from retracting, although use of an inappropriate key typically will result in several tumblers 14 being incorrectly positioned (i.e. being other than in their active positions).

In FIG. 1, all tumblers are of similar form, except for the tumbler 14 shown at the extreme right. The latter tumbler 14 is an active tumbler of a modified form, due to it being provided with a protrusion or tab 15 which projects vertically upwardly from its top edge. The arrangement of tab 15 is such that, with key mechanism 10 received in a housing in which its barrel 12 is rotatable, movement of its tumbler 14 upwardly is able to cause tab 15 to project exteriorly of the barrel for engaging in a slot or recess of the housing, to thereby preclude rotation of the barrel relative to the housing. Tab 15 will not project exteriorly of the barrel when its tumbler 14 is in its active position. However, such projection of tab 15 can occur with use of an inappropriate key or in the course of attempted picking of key mechanism 10. Thus, tab 15 can increase security. Similar tabs can be provided at each end of at least one active tumbler, or at one end of at least one active tumbler and the other end of at least one other active tumbler.

The above description of FIGS. 1 and 2, and the variant of FIG. 3, relates to vertical movement of each tumbler 14. That is, it relates to movement characterising active tumblers. However, in each case, the arrangements shown can encompass passive tumblers. Thus, for example, tumblers 14 which are passive may be secured to an movable with locking bar 16. For this arrangement, it may possibly be necessary to provide a cut-out in the inner surface of guide 18 to accommodate the outer edge of the tumbler 14 when it retracts with bar 16. In another example there may be at least one passive tumbler which is not provided with a gate 14*b*, and which is simply contacted at its outer edge, and moved laterally by bar 16 as the latter retracts. In each case, the passive tumbler 14 is moved laterally and substantially at right angles to vertical movement of active tumblers 14. However, locking bar 16 can fully retract only if the passive tumbler 14 is movable to an extent enabling this. The movement of the tumbler causes its spigot 14*a* to enter, or enter more deeply into, the blade configuration of a fully inserted key and, while an appropriate key will enable this, an inappropriate key is unlikely to do so for all passive wafers.

In the above examples of passive tumbler arrangements, the tumbler is moved inwardly with or by the locking bar. However, with a key blade configuration of varying depth along its length, the tumbler can be moved laterally towards the locking bar. Again, the locking bar 16 is only able to retract if, despite that movement, it is not blocked by the adjacent edge of the passive tumbler 14. Bar 16 will not be blocked by an appropriate key, but is likely to be blocked by at least one of the passive tumblers with use of an inappropriate key.

Numerous variants are possible in a tumbler assembly or key mechanism as described with reference to FIGS. 1 and 2, the variant of FIG. 3, and the general description which precedes reference to the drawings. Some of these now are illustrated with reference to the further drawings.

FIG. 4 is a cross-sectional view of an alternative form of tumbler assembly and key mechanism in accordance with the present invention. In this, components corresponding to those of the preceding Figures are identified by the same references. Also, the key mechanism is shown as mounted within a cylindrical cavity 40 of a partly illustrated housing 42.

In the embodiment of FIG. 4, the cross-section of a key blade 44 is shown. Also shown is a sectional representation of the blade configuration 46, projection into keyway of the spigot 14*a* of the one tumbler 14 visible, and engagement of spigot 14*a* with configuration 46. Tumbler 14 may be an active wafer or an active-passive wafer, in that it is vertically moveable solely or at least initially as shown by double headed arrow "A". Configuration 46 comprises a groove formed along a side face of blade 44 which faces towards tumbler 14 and its slot 30 in barrel 12; the latter being depicted, in part, by one of its opposed side surfaces 301. Configuration 46 undulates along the length of blade 44 with the amplitude of its undulations, whether uniform such as sinusoidal or non-uniform but smooth, extending across the side face of blade 44 and parallel to line A.

Tumbler 14 has two gates 14*b* by which it is engageable with locking bar 16. Also, bar 16 has a parallel pair of blades 16*a*, 16*b* which are vertically separated by a spacing corresponding to that between gates 14*b*. Blades 16*a*, 16*b* are complementary in form to gates 14*b* such that, in this arrangement, engagement between bar 16 and tumbler 14 is by each blade 16*a*, 16*b* being received in a respective gate 14*b*, subject to tumbler 14 being in the required position shown along line A.

In the arrangement of FIG. 4, spigot 14*a* is of a length such that it always projects into keyway 20. As a consequence, the range of vertical movement of tumbler 14 along line A is limited by the corresponding dimension of opening 20*a* to keyway 20 by which the latter is in communication with slot 28. Tumbler 14 is shown close to a lower limiting position, while the amplitude of undulations of configuration 46 need to be compatible with that range. An inappropriate key which is not compatible may not be fully receivable into slot 20.

Locking bar has a ridge 48 of triangular section along its outer face. When bar 16 is biased to its locking position, ridge 48 locates in correspondingly shaped recess 50 defined by housing 42, along cavity 40. When so located, ridge 48 prevents rotation of barrel 12 in cavity 40, relative to housing 42. However, bar 16 is shown in its retracted position, such that such rotation is possible and, in fact, partial anti-clockwise rotation of barrel 12 relative to housing 42 is shown to have occurred.

Achieving the partial and further relative rotation of barrel 12 requires insertion of an appropriate key having a blade configuration 46 which is compatible not only with the active tumbler 14 shown, but also with other tumblers whether active, passive or a combination of these types. As shown, configuration 46 has moved tumbler 14 vertically along line A to bring gates 14*b* into register with blades 16*a*, 16*b* of locking bar 16. With this, and related positioning of all other tumblers, bar 16 is able to retract, to take its ridge 48 out of locking engagement in recess 50. Attempted rotation of barrel 12 relative to housing 42 now is able to proceed, with contacting faces of ridge 48 and recess 50 in the direction of rotation providing a cam action which causes bar 16 to retract, against the action of its biasing means (such as springs 27 as shown in FIG. 1).

Subject to any other constraint, the arrangement shown allows for relative rotation between barrel 12 and housing 42 in either direction. This may be desirable in some instances. However, relative rotation in one direction can be prevented, if required, with a variety of restraints being possible for this. Thus, instead of having each pair of opposed faces of ridge 48 and recess 50 inclined as shown, one opposed pair may extent radially with respect to barrel 12.

The tumbler 14 shown in FIG. 4 may be guided in vertical movement along line A by surface 28*b* which defines part of slot 28. Tumbler 14 also can be guided by guide 18 and by blades 16*a*, 16*b* when the latter are not aligned with gates 14*b*. However, if necessary, other guiding arrangements can be provided, such as a pin (not shown) extending between the opposed pair of surfaces 28*a* of slot 28 and locating in a vertical elongate slot (not shown) formed in tumbler 14.

Any guidance provided for a tumbler 14 in vertical movement, where the tumbler 14 is an active-passive or passive-active type, needs to be compatible with successive vertical movement and then lateral movement along line B, or along line B and then line A. A variety of arrangements are possible for this even if only for example due to a sufficient degree to play in the guidance provided by surfaces 28*b* and 28*c* which enables movement along line B.

The tumbler 14 shown in FIG. 4, and any other tumbler of the key mechanism, may be biased to a central position from which it is vertically movable along line A or laterally movable along line B. Thus, by way of example only, the tumbler 14 shown may be biased to its lowermost position along line A, as limited by opening 20*a* of keyway 20, by means of a spring (not shown) mounted between surface 28*d* and the top edge of tumbler 14. Alternatively, tumbler 14 may be biased to a central position along line A by the combined action of such spring and a further spring acting against the bottom edge of tumbler 14. However, providing a surface 28*d* can be difficult and an alternative is to provide a counter-bore in slot 28 and to accommodate a larger diameter vertical compression spring in the or each counter-bore to provide the required biasing action.

FIG. 5 shows a further embodiment, in a partial view similar to that of FIG. 4. In this instance, barrel 12 has a respective series of slots 28, 28' along each side. The key blade 44 is of a form having a respective configuration 46, 46' for the tumblers 14 and 14' of each series, while there is a respective side bar 16 and 16' at each side of barrel 12, engageable in a prospective recess 50 and 50' for each bar 16, 16'. Apart from these differences from the FIG. 4 embodiment, FIG. 5 highlights, for the left hand series of tumblers 14, the different vertical movement along lines A possible for successive tumblers.

With reference to the left half of FIG. 5, locking bar 16 is shown as retracted (although relative rotation to achieve this in fact is not shown). Thus, the single blade 16*a* of bar 16 is located in the respective gate 14*b* of each of tumblers 14 of its series. However, the gate 14*b* of the wafer 14 shown in solid line has its gate 14*b* at a different location along its outer edge than the gate for each of the next two tumblers 14, shown in broken line. Engagement of blade 16*a* in the gates 14*b* implies full insertion of an appropriate key, while the staggered engagement of the successive tumblers 14 highlights different vertical movement, due to each having a different required active position on its line A relative to other tumblers.

As in the arrangement of FIGS. 1 and 2, that of FIG. 4 is such that tumblers 14 are insertable laterally into slots 30 of barrel 12 and, hence, removable therefrom. That is, slots 30 are open at face 22 to an extent accommodating this. When positioned in slots 30, tumblers 14 have freedom to move both vertically and laterally but, as evident from further description of FIGS. 1 and 2, this freedom need not be fully exercised in use of mechanism 10 with a suitable key. Also, tumblers 14 are accessible at the side of barrel 12 along which side bar 16 is provided over their full vertical extent. Additionally, tumblers 14 in movement vertically are at least progressively accessible to side bar 16 over a major part of that extent, over or during the course of vertical movement. The same considerations apply to the arrangement of FIG. 5 and subsequent embodiments herein.

FIG. 5 shows a further departure from the arrangement of FIG. 4, in that each of locking bars 16, 16' has a respective external profile which is complementary to its one of the recesses 50, 50' defined by housing 42. Thus, the left hand bar 16 has an external profile 51 which is of serrated or saw-toothed cross-section, while its recess 50 has a complementary profile 52. However, the right hand bar 16' has grooved external profile 51' and its recess 50' has a complementary profile 52' along which is provided a bead receivable into the groove of profile 51'. The arrangement is such that each of bars 16, 16' is able to return to its locking position, to enable key 44 to be withdrawn, only when barrel 12 is rotated to the position shown. That is, except when barrel 12 is in that position, bar 16 is not receivable into recess 50', and bar 16' is not receivable into recess 50, to an extent sufficient to enable key 44 to be withdrawn.

FIG. 6 is similar to the arrangement of FIG. 4 but, for the tumbler 14 shown, it provides for enhanced pick-resistance. The tumbler 14 is cut at its upper end to form a resilient tang 54 which projects therefrom towards keyway 20. Also surface 28*b* which partially defines slot 28 for tumbler 14 has an inclined portion 28*e* with which tang 54 is co-operable. If tumbler 14 is vertically moved upwardly along its third line A, beyond its intended range of movement, during an attempt to pick the mechanism, tang 54 is adapted to flex towards keyway 20, on passing portion 28*e*. With this flexing, there is provided a detent action which resists vertical downward movement of the tumbler 14, unless a suitable key for this purpose is used.

Other arrangement, which provide a similar function to tang 54, can be used. The biasing means may be a flat spring, or notch or milling in the tumbler into which a suitably biased ball or pin with a conical crown is able to lodge.

FIG. 7 shows a modified form of locking bar 116, depicted in cross-section in relation to one active tumbler 114 of its series. Bar 116 comprises an elongate rod which may be biased to its locking position by springs (not shown). However, bar 116 also is mounted so as to be rotatable around its longitudinal centre-line, relative to its barrel (not shown). As shown, the external surface of bar 116 is longitudinally grooved such that, in cross-section, it has serrations 60 around its circumference. The enabling configuration of the tumbler 114 shown comprises an arcuate gate 114*b* in which bar 116 is received when in its retracted, unlocking position. However, to each side of gate 114*b*, the outer edge of tumbler 114 defines a series of serrations 61 which, while linear, otherwise are substantially complementary to serrations 60.

With active tumbler 114 moved vertically to its active position, in which it is shown, and each other active tumbler so positioned, bar 116 is able to retract so as to be received in gate 114*b*. However, if tumbler 114 is above or below its active position, bar 116 is not able to retract. Rather, serrations 60 will mesh with one set of serrations 61. Such meshing, of course, can occur is the positioning of tumbler 114 is due to use of an inappropriate key. However, meshing can occur during attempted picking of a key mechanism having the arrangement of FIG. 7.

The form of pick-resistance illustrated in FIG. 7 also can be achieved in a key mechanism of the type shown in preceding embodiments.

In FIG. 8, there is shown a further embodiment. For ease of illustration, FIG. 8 shows only a sectional view of a pivoting locking bar 216 and one tumbler 214. Somewhat in the manner of the FIG. 7 arrangement, tumbler 214 has a gate 214*b* and spaced slightly from gate 214*b*, a series of saw-tooth serrations 261. The bar 216 has one blade 216*a* which is complementary in form to gate 214*b*, and a pointed blade 216*b* which is intended to engage serrations 261. With tumbler 214 in its intended active position, blade 216*b* engages an intended one of the serrations 261, with blade 216*a* then aligned with gate 214*b*. Blade 216*b* may be slightly longer than blade 216*a* and, with its engagement in the intended serration 261, bar 261 is caused to cant to bring its blade 216*a* into engagement with gate 214*b*. However, if during an attempt at picking a lock provided with the FIG. 8 mechanism, tumbler 214 is not quite moved vertically to its intended active position, blade 216*b* will engage another one of serrations 261, with canting of bar 216 to engage its blade 216*a* in gate 214*b* then being prevented. Thus, as with the FIG. 7 arrangement, bar 216 is prevented from retracting to effect unlocking.

FIG. 9 shows partial detail of a still further modification, illustrating only a locking-bar 316 and selected tumblers 314 of a series. As shown, bar 316 in the form of a round bar which is provided along its length with annular grooves 301 for some tumblers 314. The left hand tumbler 314 is a passive tumbler having an unconfigured outer edge which, due to alignment with a groove 301, enables retraction of bar 316 against the action of its biasing means, if any, such as springs 27 as shown in FIG. 1. The right hand tumbler 314 is an active tumbler having a configured outer edge which, subject to that tumbler having been moved vertically to its active position, enables retraction of bar 316. The configuration of the right hand tumbler 314 is a gate 314*b* of complementary form to the round full section of bar 316.

The left hand passive tumbler 314 of FIG. 9 has an actuating configuration at its inner edge for engaging a key blade configuration and comprising a triangular spigot 314*a*. The purpose of this form of spigot is best explained with reference to FIG. 10. However, before referring more specifically to FIG. 10, it will be noted that the inner edge configuration of the right hand, active tumbler 314 comprises a gate 314*a*, with which a key blade configuration comprising a fin is engageable.

FIG. 10 shows a key having a key blade configuration 413 and three tumblers 414 of a mechanism. The arrangement shown for the key blade configuration 413 and tumblers 414 is as for the key inserted into a keyway for the key mechanism to locate each of the tumblers in their active positions. As is evident, the key has been inserted from the left, with the mechanism of which tumblers 414 form part being in an orientation corresponding to that of FIG. 1.

During insertion of the key, in the orientation of FIG. 10, its leading end first passes the left hand tumbler 414 which is of the passive type, then the intermediate, active tumbler 414 and finally the right hand, active tumbler 414. The active tumbler 414 has an actuating configuration defining a spigot 414*a* co-operable with a groove 413*a* comprising at least part of the key blade configuration, while each tumbler has an enabling configuration comprising a gate 414*b* in which a locking bar (not shown) is receivable. The arrangement for spigot 414*a* and key blade configuration thus is the converse of that required in FIG. 9.

The key blade also has a secondary configuration 404 with which the passive tumblers 414 are co-operable, while each passive tumbler 414 has a secondary configuration for this purpose. Over a first part of its length from the leading end of the key, the secondary configuration is concave and is defined by a V-section groove 404*a* while, over a second part of its length, the secondary configuration is convex and comprises a V-section bead or rib 404*b*. The left hand passive tumbler 414 has a secondary configuration which comprises a V-section gate 414*c* which does not interact with groove 404*a* of the concave portion of the key blade secondary configuration, but does receive and co-operate with rib 404*b* of the convex portion. The right hand passive tumbler 414 has a secondary configuration which comprises a V-shaped spigot 414*d* and is receivable in groove 404*a* of the concave portion of the key blade secondary configuration.

Co-operation between the respective parts 404*a*, 404*b* of the secondary configuration necessitates use of an appropriate key. Use of an inappropriate key which has a concave portion which is too narrow or insufficiently deep to appropriately receive spigot 414*d*, or a secondary portion which is too wide or too deep to be received in gate 414*c*, of at least one passive tumbler 414. Thus, retraction of the locking bar will be precluded. Also, separation between parts 404*a*, 404*b* and the key blade configuration 413 allows for a multiplicity of keys to be passed into, or excluded from, the keyway without disclosing the precise nature of the compatibility, or incompatibility, as the case may be.

The embodiment of the key mechanism described and illustrated herein are not limiting on the invention or exhaustive of possibilities. Thus, where there is at least two series of tumblers, at least one active tumbler of one series can be linked by a bridging element to a respective active tumbler of another series. Also, in the or any one series, two or more active tumblers can be linked to another by a bridging element. Particularly in the latter case, the bridging element may be integral with the tumblers between which it extends, or it may be such as to provide a lost-motion coupling therebetween. Where the bridging element is integral, the tumblers and the bridging element therebetween may be formed from a single stamping operation and bending to the final form.

The key mechanism may be receivable into a housing for relative rotation therein to provide a locking/unlocking action. However, the mechanism may be provided in a housing in which it provides such action without relative rotation. In the latter case, the locking bar may project from its barrel so as to project through the housing such that the locking/unlocking action is provided for a component remote from the barrel.

In the key mechanism of the invention, at least one active tumbler can be resiliently biased vertically to a rest position. The rest position most preferably is vertically spaced from the active position for at least one of a plurality of active tumblers which are so biased.

A tumbler assembly or key mechanism according to the invention most preferably has a plurality of active tumblers and a plurality of passive tumblers. The number of tumblers can vary with an intended use of the mechanism. As will be appreciated, the number of combinations possible in a relatively simple arrangement can be vast, even where only one series of tumblers is provided. In one preferred arrangement, engagement between the locking bar and the tumblers is dictated by a relationship between a configuration defined by the locking bar and the configuration of an original suitable key, such that the mechanism is able to be recombinated for use with a suitable key of different configuration by replacing the locking bar with a locking bar having a different configuration, and such that after the replacement, the original key will not operate the mechanism without removal, and replacement or re-arrangement, of the tumblers.

In the preceding description, reference generally is to a mechanism indicated as having a keyway, implying only a single keyway. However, there may be first and second substantially parallel and laterally offset keyways. In such case, each keyway has at least one respective series of tumblers, each with a respective locking bar, with there being a similar relationship between each keyway, tumblers and locking bar grouping as for each other grouping.

FIG. 11 shows components of a key mechanism according to an embodiment of what is previously referred to as a second variant of a second form of the invention. In contrast, FIGS. 1 to 10 relate to embodiments of that referred to as the first form.

In FIG. 11, there is shown a locking bar 516 and its relationship to two tumblers 514. For ease of illustration, the barrel of the key mechanism of which those components form part has been omitted. Also, others of the series to which tumblers 514 belong similarly have been omitted, while configuring of bar 516 is shown only as required for the two tumblers 514 shown. A housing, in which the mechanism having the illustrated components is mountable, is represented by wall 542; that wall being a longitudinally inner, end wall of a cavity defined by the housing, which is opposed to the second end of the barrel on to rotational or sliding support means.

Locking bar 516 extends longitudinally within the barrel of its key mechanism, at a location between, and laterally spaced from, the keyway and the external peripheral surface of the barrel. Bar 516 is of circular cross-section and is longitudinally moveable in its barrel along a line parallel to the axis of rotation of the barrel. A spring 527, mounted in the first end of the barrel, acts against the adjacent end 516*a* of the bar 516 to bias the latter to its locking position. In that position, the cone-shaped other end 516*b* of bar 516 located in conical recess 542*a* formed in wall 542, to preclude rotation of the barrel in the housing while bar 516 is held in its locking position by tumblers 514. When tumblers 514 are in their active positions (as shown), bar 516 is retractable relative to its barrel, against the action of spring 527. This retraction is achieved by initial rotation of the barrel, or by rotation or sliding of other support means, causing a cam action between conical end 516*b* and conical recess 542*a*, enabling further rotation of the barrel.

In FIG. 11, the left hand tumbler 514 is a passive tumbler, having a secondary, V-shaped spigot 514*d* which functions in the manner of spigot 414*d* of FIG. 10. The right hand tumbler 514 is an active tumbler, having an actuating configuration comprising a spigot 514*a*. Each tumbler has an enabling, internal configuration 514*b* which is in the form of a keyhole shaped aperture through which bar 516 extends. The passive tumbler has its configuration 514*b* disposed such that the keyhole form is lateral, while the active tumbler has its configuration 514*b* disposed such that its keyhole form is vertical (but inverted relative to normal representation of a keyhole).

For each of the tumblers 514, bar 516 is shown as having a respective annular groove 516*c*. As bar 516 is in its locking position, with its end 516*b* located in recess 542*e*, and each of tumblers 514 is in its active position due to insertion of an appropriate key, each groove 516*c* is within the larger section of the respective keyhole configuration 514*b*. That larger section of each configuration 514*b* is of a size able to accommodate the adjacent full cross-section of bar 516 such that, rotation of the barrel is possible to cause longitudinal retraction of bar 516 relative to the barrel. However, with withdrawal of the key, tumblers 514 will move from their active positions. When this occurs, the smaller section of each configuration 514*b* will be received onto the reduced cross-section of bar 516 at the respective recess 516*c*. Each smaller section of configuration 514*b* is dimensioned to accommodate the reduced section of bar 516 at is recess 516*c*, but not to accommodate the full section of bar 516. Thus, when tumblers 514 are moved from their active positions, their configurations 514*b* retain bat 516 in its locked position.

Active tumbler 514 is moved to its active position by insertion of a suitable key, such as against the bias of a spring. On withdrawal of the key, that bias will move it from its active position.

Passive tumbler 514 may in fact be biased laterally to its active position, by a spring action at its side remote from spigot 514*d*. Thus passive tumbler 514 may move from its active position only during withdrawal of the key, and thereafter return to its active position. In that event, passive tumbler 514 acts principally to preclude retraction of bar 516 relative to its barrel if an inappropriate key, which does not accommodate spigot 514*d* in the manner described with reference to FIG. 10, is used.

In an alternative arrangement for passive tumbler 514 of FIG. 11, or for other passive tumblers of its series, configuration 514*b* may be reversed end for end, and its tumbler 514 biased laterally away from its active position by a spring acting at its side remote from spigot 514*d*. In that case, passive tumbler 514 will be moveable under the action of the spring to retain bar 516 in its locking position. However, on insertion of a suitable key, it will be moved against that bias to its active position. Similarly, configuration 514*b* of the active tumbler 514, or another active tumbler of its series, can be inverted end for end and its tumbler 514 biased vertically upwardly by a spring, away from its active position.

The arrangement of FIG. 12 is in accordance with the first variant of the abovementioned second form. Parts corresponding to those of FIG. 11 have the same reference numeral. The nature of the arrangement readily will be understood from the description of FIG. 11, and the following is directed to detail by which these embodiments differ.

In FIG. 12, locking bar 516 extends in an external recess defined by its barrel, similar to recess 628 of FIG. 13. Thus, bar 516 extends across the outer side of tumblers 514, with the latter enabling, external configurations 514*b*.

Each of tumblers 514 has a plate-like portion 515*a* which defines the respective configuration 514*d*, 514*a*. Also, each has a somewhat cylindrical portion 515*b* which is integral with portion 515*a*. Portion 515*b* defines the respective enabling configuration 514*b*.

Configurations 514*b* are in the form of arcuate gates. Each configuration 514*b* is dimensioned so as to be able to accommodate a full cross-section portion of bar 516, with it of course being necessary that tumblers 514 are in their active position for this. However, the arrangement is such that, at least in the case of the active tumbler 514 (i.e. the right hand one), its configuration is vertically out of alignment along its third line A, when not in its active position, so as to receive a reduced section at a recess 542*a*, such that retraction of bar 516 is precluded.

FIG. 13 shows an arrangement similar to FIG. 12, but providing an exploded view including barrel 612, and having tumblers 614 similar to those of FIG. 1. Operation of the arrangement of FIG. 13 will be understood from the description on the embodiments of preceding Figures.

Figure 14:
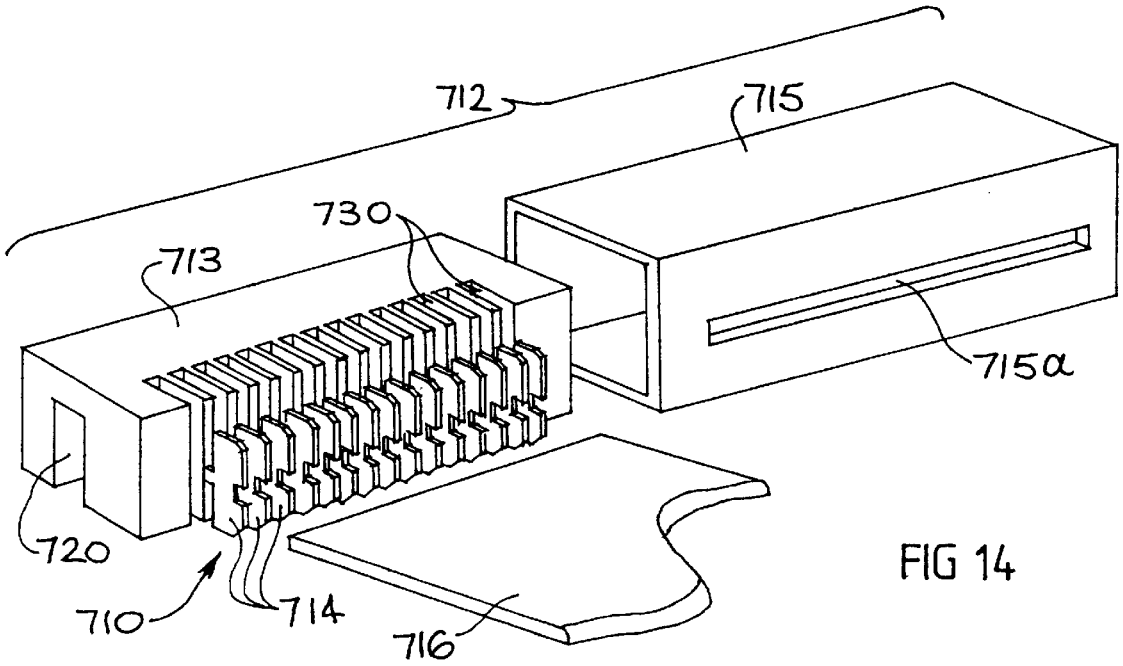

FIG. 14 schematically illustrates a still further form of tumbler assembly 710 and a key mechanism 712 of which assembly 710 is able to form part. Assembly 710 includes support means 713 in which a series of tumblers 714 is mountable. Mechanism 712 includes assembly 710, and further includes housing sleeve 715 in which assembly 710 is longitudinally receivable, and side bar 716.

Support means 713 is of rectangular block form, but has a series of longitudinally spaced, lateral slots 730 formed inwardly from one side thereof, and an inverted U-shaped channel 720 which, when assembly 710 is received in sleeve 715, defines a longitudinal keyway. Each slot 730 opens at its laterally inner edge to channel 720. One side of sleeve 715 defines an elongate slot 715*a* which extends longitudinally across each tumbler 714 and in which an end of side bar 716 is received, with bar 716 biased away from tumblers 714. Beyond these details, operation with the arrangement of FIG. 14 will be understood from preceding description.

Figure 15:
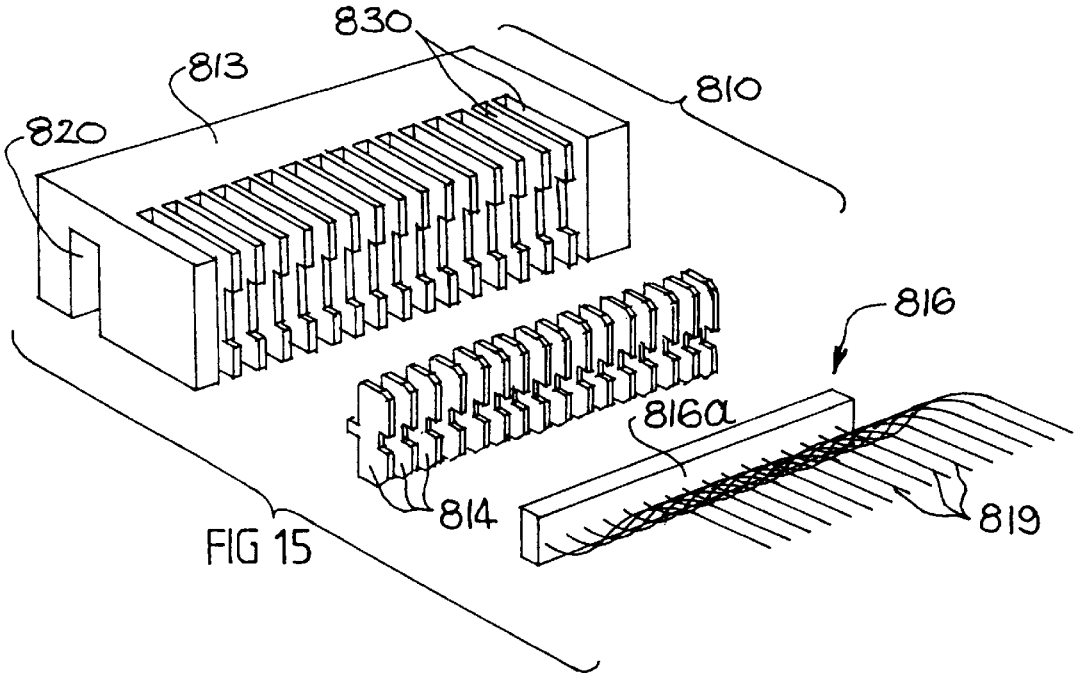

FIG. 15 shows schematically a tumbler assembly 810 and an elongate side member 816 with which assembly 810 is intended to be used. Assembly 810 is intended to be mounted in a housing which defines a cavity similar to the interior of sleeve 715 of FIG. 14 and which is able to be associated with a n electrically operable system, such as a computer. In being so mounted, assembly 810 would have side member 816 mounted longitudinally across the laterally outer side of slots 830 and of tumblers 814 in the previously described manner.

Side member 816 comprises an electrically insulating body 816*a*, in which it embedded a terminal end (now shown) for a number of circuit leads 819 of enabling circuitry for the electrically operable system. The arrangement is such that, on insertion of a suitable key in a keyway defined in part by channel 820, tumblers 814 are moved to their active positions. The key may be one of two or more suitable keys, fort each of which at least some tumblers 814 have a respective active position. Depending on which key is used, respective tumblers 814, when in their active positions for that key, engage terminal ends of and complete circuitry for selected ones of leads 819, to enable operation of the electrically operable system to a predetermined level of security clearance.

Figure 16:
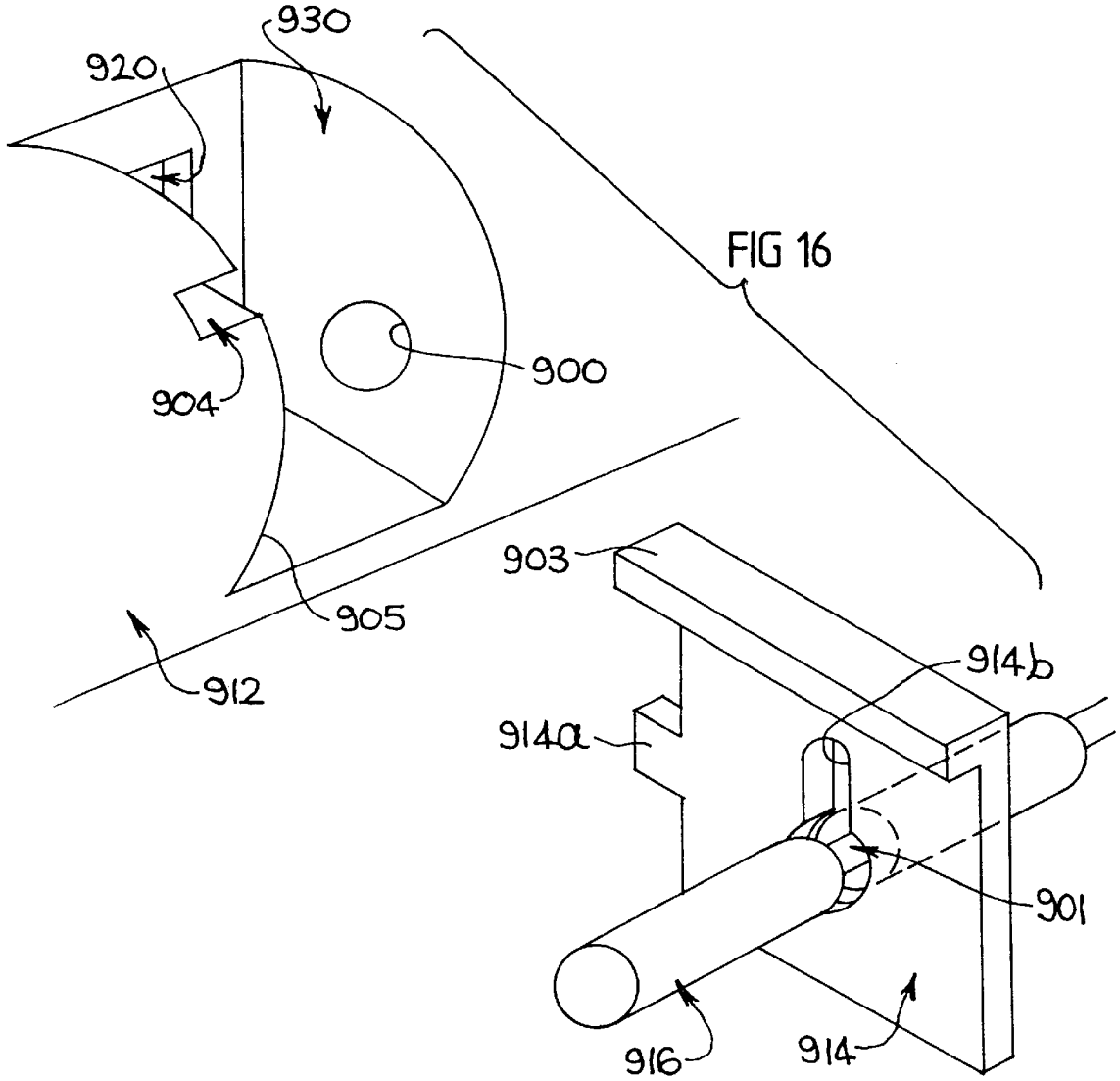

FIG. 16 illustrates one arrangement showing how a tumbler can be movable vertically, laterally and longitudinally. FIG. 16 in fact is a partially exploded view, illustrating part of a barrel 912, a single tumbler 914 of a series of tumblers mountable in barrel 912, and an end bar 916. The part of barrel 912 shown has a lateral slot 930 formed therein, in which the one tumbler 914 is received. Slot 930 communicates with a longitudinal keyway 920 formed in barrel 912.

The part of barrel 912 containing slot 930 has a longitudinal bore 900 therethrough, in which end bar 916 is receivable and longitudinally movable. To enable this, with tumbler 914 received in slot 930, tumbler 914 defines an opening 914*b*, of keyhole form, by which tumbler 914 is configured for co-operation with end bar 916. Also, in portion extending across slot 930, side bar has an annular groove 901. Also, tumbler 914 has a flange 903 along its upper edge which projects longitudinally and, with tumbler 914 received in slot 930, flange 903 is able to locate in lateral groove 904 formed in one side face 905 of slot 930. The engagement between flange 903 and groove 904 is such as to positively locate tumbler 914 in one stage its movement.

Tumbler 914 as an actuating configuration at its first lateral side which comprises a spigot 914*a*. With insertion of an appropriate key in the keyway of barrel 912, spigot 914*a* is received in a vertically undulating groove comprising a configuration along the blade of the key. As a consequence, tumbler 914 is vertically movable. Also, this movement is permitted by opening 914*b*. Also, the depth of the groove configuration of the key blade can vary longitudinally, with this causing lateral movement of tumbler 914, as also permitted by opening 914*b*. After required vertical and lateral movement of tumbler 914, and assuming appropriate positioning of other tumblers to enable longitudinal movement of bat 916, the arrangement will be such that the reduced diameter portion of bar 916 at annular groove 901 will be located in the laterally narrower portion of keyhole configuration 914*b*. Thus, with longitudinal movement of bar 916 (to the left in FIG. 16), tumbler 914 will be moved longitudinally by bar 916 to locate flange 903 in groove 904. For this, it of course is required that the diameter of bar 914, to each side of groove 901, is greater than the laterally narrower portion of configuration 914*b*. Reverse longitudinal movement of bar 916 moves tumbler 914 to free flange 903 from groove 904, after which tumbler 914 again is able to move laterally and vertically on withdrawal of the key.

Finally, it is to be understood that various alterations, modifications and/or additions may be introduced into the constructions and arrangements of parts previously described departing from the spirit or ambit of the invention.

I claim:

1. A tumbler assembly, for a key operable locking mechanism, including a plurality of tumblers and means for supporting the tumblers; wherein, with the assembly suitably orientated relative to a three-axis co-ordinate system for which designation of axes as being vertical, lateral and longitudinal is appropriate, the tumblers are mounted in the support means in a series which extends longitudinally in the support means in an arrangement such that each tumbler is able to move to and away from at least one respective active position by substantially linear movement relative to the support means in at least one direction selected from vertical, lateral and longitudinal; wherein the support means has first and second laterally opposite sides and each tumbler is accessible at both the first and second of said sides, at least one tumbler being engageable with a key blade of a suitable key when said blade is present along said first side; and wherein each of said tumblers is accessible at said second side whereby each tumbler is insertable into and removable from the support means at said second side.

2. An assembly according to claim 1, wherein at least one tumbler is configured at said first side for engagement with said blade of a suitable key present at said first side for affecting its movement of said tumbler.

3. An assembly according to claim 2, wherein movement for at least one tumbler is at least in part vertical movement.

4. An assembly according to claim 2, wherein at least one tumbler when in an active position can enable unlocking.

5. An assembly according to claim 2, wherein the support means forms at least part of a housing which defines at least part of a longitudinal keyway which extends along said first side and in which said blade of a suitable key is insertable for engaging the first side configuration of said at least one tumbler.

6. An assembly according to claim 1, wherein at least one further tumbler, in addition to the tumblers of the series, is mounted in the support means.

7. An assembly according to claim 3, wherein the support means comprises at least part of a member which is mountable in relation to another component of a key mechanism in which the tumbler assembly is to be used, to define a longitudinal keyway which extends along said first side and in which said blade of a suitable key is insertable for engaging the first side configuration of said at least one tumbler movable in the vertical direction.

8. An assembly according to claim 1, wherein at least one tumbler is connectable into an electrical system and movement of said at least one tumbler effects data transmission within the system.

9. An assembly according to claim 8, wherein said support means has electrically isolated conductivity elements and electrical connections between said elements and a number of terminals enable operative electrical connection between the support means and a circuit external to the support means, and wherein electrical continuity is able to be established by at least one tumbler moving to a required position.

10. An assembly according to claim 1, wherein at least one tumbler is connectable into an electronic system and movement of said at least one tumbler effects an electrical continuity within the system.

11. An assembly according to claim 8 or claim 10, wherein the mechanism further includes a housing of which the support means forms a part, a keyway which extends across the first lateral side of at least one tumbler and a mounting device having a series of electrically conductive elements which are mounted on an electrically insulating backing of an electrically operable system and electrical continuity and discontinuity is able to be established in the conductive elements on movement of respective tumblers.

12. An assembly according to claim 8 or claim 10, when forming part of a key mechanism, which is able to be electronically monitored in respect of the positions of the tumblers; wherein the mechanism includes a monitoring device and at least one tumbler is configured so as to enable the position of said at least one tumbler, relative to the support means, to be monitored by the monitoring device.

13. An assembly according to claim 8 or claim 10 wherein the mechanism further includes a housing in which the support means is received, a keyway which extends across the first lateral side of at least one tumbler and a mounting device having a series of electrically conductive elements which are mounted on an electrically insulating backing of an electrically operable system and electrical continuity and discontinuity is able to be established in the conductive elements on movement of respective tumblers.

14. An assembly according to claim 12, wherein the mechanism includes a housing in which the support means is received and a keyway extends across the first lateral side of at least some tumblers, the monitoring device has a series of terminals for respective electrical conductors for control circuitry of an electrically operable system, with the terminals mounted and spaced from each other in an electrical insulating support, and wherein electrical continuity and discontinuity is able to be established between at least selected sub-groups of the terminals by at least selected sub-groups of tumblers on position of those tumblers in respective active positions for actuating circuitry for the system which enables use within the system.

15. An assembly according to claim 14, wherein a level of use within the system is at a level consistent with a level of security associated with the key used.

16. An assembly according to claim 14, wherein a level of use within the system is at a level different to a level of security associated with the key being used.

17. An assembly according to claim 12, further including a monitoring device which is located adjacent to the support means and which has sensor means for sensing a signal, wherein at least one tumbler is adapted to influence the output of electrical or electronic components of the system, and wherein the sensor means is adapted to provide an output signal indicative of the relative position of at least one tumbler when said at least one tumbler is moved.

18. An assembly according to claim 12, wherein the mechanism includes a housing of which the support means forms a part and a keyway extends across the first lateral side of at least some tumblers, the monitoring device has a series of terminals for respective electrical conductors for control circuitry of an electrically operable system, with the terminals mounted and spaced from each other in an electrical insulating support, and wherein electrical continuity and discontinuity is able to be established between at least selected sub-groups of the terminals by at least selected sub-groups of tumblers on position of those tumblers in respective active positions for actuating circuitry for the system which enables use within the system.

19. An assembly according to claim 8, wherein the mechanism includes a member which has electrical or electronic components and which is located adjacent at least one of the tumblers.

20. An assembly according to claim 8, wherein electrical continuity is able to be provided by at least part of the blade of a suitable key.

21. An assembly according to claim 8, wherein electrical continuity is able to be provided by at least part of the support means.

22. An assembly according to claim 12, wherein a part other than the support means and the tumblers is adapted to provide for monitoring by sensors of the relative positions of the tumblers.

23. An assembly according to claim 12, wherein the tumblers are adapted to provide for monitoring by sensors of the relative positions of the tumblers.

24. An assembly according to claim 12, wherein a part other than the support means and the tumblers is adapted to provide for monitoring by sensors of the relative positions of the tumblers.

25. An assembly according to claim 1, wherein at least some tumblers are at least partly configured at the first lateral side thereof by having a laterally projecting portion which is co-operable with a configured surface of a suitable key which surface in use is arranged to be disposed generally in the longitudinal direction.

26. An assembly according to claim 25, wherein at least one tumbler is at least partly configured at said first side by having a lateral opening co-operable with said configured surface of said blade of a suitable key.

27. An assembly according to claim 25, wherein at least one of the tumbler is configured at said second lateral side for engagement when in an active position with a side bar.

28. An assembly according to claim 27, wherein at least one tumbler is adapted to be effectively recombinated with recombination being achieved at least in part by replacing the locking bar of the mechanism with a different one which has a pattern corresponding to a differing resultant displacement of the at least one tumbler in co-operation with the configuration of a different suitable key.

29. An assembly according to claim 1, wherein at least one tumbler is in the form of a wafer defining major surfaces disposed vertically and laterally.

30. An assembly according to claim 29, wherein at least one tumbler is located in a laterally extending slot defined by said support means.

31. An assembly according to claim 29, wherein at least two tumblers are in face to face sliding contact with each other.

32. An assembly according to claim 1, wherein at least one tumbler is biased to a predetermined position.

33. An assembly according to claim 1, wherein at least one further said series of tumblers is mounted in said support means.

34. A tumbler assembly, for a key operable locking mechanism, including a plurality of tumblers and means for supporting the tumblers; wherein, with the assembly suitably orientated relative to a three-axis co-ordinate system for which designation of axes as being vertical, lateral and longitudinal is appropriate, the tumblers are mounted in the support means in a series which extends longitudinally in the support means in an arrangement such that each tumbler is able to move to and away from at least one respective active position by substantially linear movement relative to the support means in at least one direction selected from vertical, lateral and longitudinal, subject to there being at least one tumbler able to move vertically; wherein the support means has first and second laterally opposite sides and each tumbler is accessible at both the first and second of said sides, at least one tumbler being engageable with a key blade of a suitable key when said blade is present along said first side; wherein each of said tumblers is accessible at said second side whereby each tumbler is insertable into and removable from the support means at said second side; and wherein said support means comprises at least a part of a cylindrical barrel which is rotatably receivable in a housing so as to be rotatable therein.

35. An assembly according to claim 34 further including a locking bar which is movable between a locking position to which the locking bar is able to be resiliently biased and in which the locking bar projects from the barrel and an unlocking position; the arrangement being such that with insertion of said blade of a suitable key in a keyway defined along said first side, at least some of the tumblers are able to move to respective active positions enabling the locking bar to be moved to said unlocking position.

36. An assembly according to claim 34 when forming part of a key mechanism including a housing in which said cylindrical barrel is rotatably received, wherein at least part of a keyway is defined along said first side and wherein said housing defines a recess into which a portion of at least one tumbler can enter thereby preventing rotation of said barrel in said housing, the arrangement being such that with insertion of said blade of a suitable key in the keyway, said portion of at least one tumbler is withdrawn from said recess to free said barrel for rotation within said housing.

37. An assembly according to claim 36, further including a locking bar which is movable between a locking position to which the locking bar is able to be resiliently biased to project from the barrel and an unlocking position, the arrangement being such that with insertion of said blade of a suitable key in the keyway defined along said first side, at least some of the tumblers are able to move to respective active positions enabling the locking bar to be moved to said unlocking position.

38. An assembly according to claim 35, wherein said locking bar is a side bar and extends longitudinally, across the second lateral side of at least one tumbler which is configured at said second lateral side for engagement, when in an active position, with the side bar.

39. An assembly according to claim 35, wherein said locking bar is a bar which is able to be longitudinally biased and extends longitudinally, across the second lateral side of at least one tumbler which is configured at said second lateral side for engagement, when in an active position, with the side bar.

40. An assembly according to claim 35, wherein said locking bar is able to be longitudinally biased and extends longitudinally through a respective opening provided in each tumbler in said series intermediate to said first and second lateral sides, and wherein the opening of at least one tumbler is configured for engagement, when in an active position, with the locking bar.

41. A tumbler assembly, for a key operable locking mechanism, including a plurality of tumblers and means for support the tumblers; wherein, with the assembly suitably orientated relative to a three-axis co-ordinate system for which designation of axes as being vertical, lateral and longitudinal is appropriate, the tumblers are mounted in the support means in a series which extends longitudinally in the support means in an arrangement such that each tumbler is able to move to and away from at least one respective active position by substantially linear movement relative to the support means in at least one direction selected from vertical, lateral and longitudinal; wherein the support means has first and second laterally opposite sides, and each tumbler is accessible at both the first and second of said sides, at least one tumbler being engageable with a key blade of a suitable key when said blade is present along said first side; wherein at least one of said tumblers is accessible at said second side whereby each tumbler is insertable into and removable from the support means at said second side; and wherein the support means comprises at least part of a non-rotatable body.

42. An assembly according to claim 41, wherein said support means defines at least a part of a keyway along said first side and the mechanism includes a locking bar which is movable between a locking position to which the locking bar is able to be resiliently biased to project through a wall of said body and an unlocking position, for respectively precluding and enabling movement of an external member with which the assembly is associated in use; the arrangement being such that with insertion of said blade of a suitable key in the keyway at least one tumbler is able to move to an active position enabling the locking bar to be moved to said unlocking position.

* * * * *

UNITED STATES PATENT AND TRADEMARK OFFICE

CERTIFICATE OF CORRECTION

PATENT NO. : 5,826,451 PAGE 1 of 3

DATED : OCTOBER 27, 1998

INVENTOR(S) : COOK

It is certified that error appears in the above-identified patent and that said Letters Patent is hereby corrected as shown below:

Title page, [56] References Cited, U.S. Patent Documents: insert the following in numerical order:

| | | | | |
|---|---|---|---|---|
| --1,328,074 | 1/1920 | Bennett | | -- |
| --1,900,794 | 3/1933 | Brun | | -- |
| --2,030,836 | 2/1936 | Full et al. | 70/46 | -- |
| --2,079,628 | 5/1937 | Olson | 70/364 | -- |
| --2,155,734 | 4/1939 | Olson | 70/358 | -- |
| --3,367,156 | 2/1968 | Johnstone | 70/366 | -- |
| --3,475,933 | 11/1969 | Kobrehel | 70/364 | -- |
| --3,479,848 | 11/1969 | Golden | 70/364 | -- |
| --3,707,863 | 1/1973 | Schwab et al. | 70/377 X | -- |
| --3,709,006 | 1/1973 | Seidewand | 70/377 X | -- |
| --3,722,241 | 3/1973 | Sussina | 70/377 X | -- |
| --3,999,413 | 12/1976 | Raymond et al. | 70/377 X | -- |
| --4,015,458 | 4/1977 | Mercurio | 70/377 X | -- |
| --4,015,848 | 4/1977 | Pauwels | 273/126R | -- |
| --4,085,601 | 4/1978 | Sauder | 70/377 X | -- |
| --4,225,008 | 9/1980 | Colell et al. | 70/237 X | -- |

UNITED STATES PATENT AND TRADEMARK OFFICE

CERTIFICATE OF CORRECTION

PATENT NO. : 5,826,451

DATED : OCTOBER 27, 1998

INVENTOR(S) : COOK

It is certified that error appears in the above-identified patent and that said Letters Patent is hereby corrected as shown below:

Title page, [56] References Cited, Foreign Patent Documents: insert the following in order by country and date:

| | | |
|---|---|---|
| --48,503/59 | 11/1959 | Australia-- |
| --231118 | 11/1960 | Australia-- |
| --10543/76 | 7/1977 | Australia-- |
| --52644/79 | 5/1980 | Australia-- |
| --20676/83 | 5/1984 | Australia-- |
| --407 799 | 9/1966 | China-- |
| --660 619 | 5/1987 | China-- |
| --17-366 | 10/1980 | European Patent Off.-- |
| --57-475 | 8/1982 | European Patent Off.-- |
| --1 254 482 | 11/1971 | Finland-- |
| --1 256 794 | 12/1971 | Finland-- |
| --2 572 117 | 4/1986 | France-- |
| --586,701 | 4/1947 | Great Britain-- |
| --2 038 401 | 7/1980 | Great Britain-- |
| --4-231567 | 8/1992 | Japan-- |
| --5-287941 | 11/1993 | Japan-- |

UNITED STATES PATENT AND TRADEMARK OFFICE

CERTIFICATE OF CORRECTION

PATENT NO. : 5,826,451 PAGE 3 of 3

DATED : OCTOBER 27, 1998

INVENTOR(S) : COOK

It is certified that error appears in the above-identified patent and that said Letters Patent is hereby corrected as shown below:

Col. 17, line 41: insert the following paragraphs:

—FIG. 12 is a perspective view of a further alternative embodiment;

FIG. 13 is a perspective view of a further alternative embodiment;

FIG. 14 is a perspective view of a still further alternative embodiment;

FIG. 15 is a perspective view of another alternative embodiment; and

FIG. 16 is a perspective view of still another alternative embodiment of the invention.—

Col. 31, lines 9–10, claim 22: delete "a part other than"

Col. 31, line 10, claim 22: delete "and the tumblers"

Signed and Sealed this

Twenty-first Day of March, 2000

*Attest:*

*Attesting Officer*

Q. TODD DICKINSON

*Commissioner of Patents and Trademarks*